US010333198B2

(12) United States Patent
Ito et al.

(10) Patent No.: US 10,333,198 B2
(45) Date of Patent: Jun. 25, 2019

(54) ANTENNA APPARATUS AND COMMUNICATION TERMINAL APPARATUS

(71) Applicant: Murata Manufacturing Co., Ltd., Nagaokakyo-shi, Kyoto-fu (JP)

(72) Inventors: Hiromitsu Ito, Nagaokakyo (JP); Hiroshi Nishida, Nagaokakyo (JP); Kunihiro Komaki, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/700,439

(22) Filed: Sep. 11, 2017

(65) Prior Publication Data

US 2018/0013202 A1 Jan. 11, 2018

Related U.S. Application Data

(63) Continuation of application No. PCT/JP2016/056911, filed on Mar. 7, 2016.

(30) Foreign Application Priority Data

Mar. 12, 2015 (JP) ..... 2015-049887

(51) Int. Cl.
*H01Q 1/24* (2006.01)
*H01Q 1/42* (2006.01)
(Continued)

(52) U.S. Cl.
CPC ..... *H01Q 1/243* (2013.01); *H01Q 1/42* (2013.01); *H01Q 5/321* (2015.01); *H01Q 5/328* (2015.01);
(Continued)

(58) Field of Classification Search
None
See application file for complete search history.

(56) References Cited

U.S. PATENT DOCUMENTS 5,923,298 A 7/1999 Miyahara et al.
6,094,123 A 7/2000 Roy
(Continued)

FOREIGN PATENT DOCUMENTS

JP 10-327009 A 12/1998
JP 2000-114050 A 4/2000
(Continued)

OTHER PUBLICATIONS

Official Communication issued in International Patent Application No. PCT/JP2016/056911, dated May 17, 2016.

*Primary Examiner* — Robert Karacsony
(74) *Attorney, Agent, or Firm* — Keating & Bennett, LLP

(57) ABSTRACT

An antenna apparatus includes a conductive radiating element, a conductive member, and a first impedance circuit. The first impedance circuit includes a first parallel resonant circuit (an LC parallel resonant circuit) and is directly connected between the radiating element and the conductive member (the conductor plate). Since the first parallel resonant circuit has high impedance in its resonant frequency band and is equivalently in an open state, one end of the radiating element is opened in the resonant frequency band. Accordingly, the radiating element defines and functions as a standing-wave antenna that contributes to electric-field radiation and a loop portion including the radiating element, the conductive member, and the first impedance circuit defines and functions as a magnetic-field radiation antenna that contributes to magnetic-field radiation.

8 Claims, 31 Drawing Sheets

(51) Int. Cl.

| | |
|---|---|
| ***H01Q 7/08*** | (2006.01) |
| ***H01Q 9/42*** | (2006.01) |
| ***H01Q 5/321*** | (2015.01) |
| ***H01Q 5/328*** | (2015.01) |
| ***H01Q 5/335*** | (2015.01) |

(52) U.S. Cl.
CPC ..... *H01Q 5/335* (2015.01); *H01Q 7/08* (2013.01); *H01Q 9/42* (2013.01)

(56) References Cited

U.S. PATENT DOCUMENTS

| | | | | |
|---|---|---|---|---|
| 2013/0135164 | A1 | 5/2013 | Asanuma et al. | |
| 2013/0307746 | A1* | 11/2013 | Nakano ..... | H01Q 1/2225 343/850 |
| 2014/0176383 | A1 | 6/2014 | Yosui et al. | |
| 2015/0116168 | A1 | 4/2015 | Yosui | |
| 2015/0249292 | A1* | 9/2015 | Ouyang ..... | H01Q 21/30 343/702 |

FOREIGN PATENT DOCUMENTS

| | | | |
|---|---|---|---|
| JP | 2000-348941 | A | 12/2000 |
| JP | 2000-353634 | A | 12/2000 |
| JP | 2007-124458 | A | 5/2007 |
| JP | 2009-038651 | A | 2/2009 |
| JP | 2014-239539 | A | 12/2014 |
| WO | 2013/008356 | A1 | 1/2013 |
| WO | 2013/168558 | A1 | 11/2013 |
| WO | 2014/098024 | A1 | 6/2014 |

* cited by examiner

ANTENNA APPARATUS AND COMMUNICATION TERMINAL APPARATUS

CROSS REFERENCE TO RELATED APPLICATIONS

This application claims the benefit of priority to Japanese Patent Application No. 2015-049887 filed on Mar. 12, 2015 and is a Continuation Application of PCT Application No. PCT/JP2016/056911 filed on Mar. 7, 2016. The entire contents of each application are hereby incorporated herein by reference.

BACKGROUND OF THE INVENTION

1. Field of the Invention

The present invention relates to antenna apparatuses. More particularly, the present invention relates to an antenna apparatus shared among communication systems using communication signals of different frequency bands. The present invention also relates to a communication terminal apparatus including the antenna apparatus.

2. Description of the Related Art

Communication antennas and antennas for various communication (broadcasting) systems including Global Positioning System (GSP), wireless local area network (LAN), digital terrestrial broadcasting have been incorporated in electronic devices with an increase in function of the antennas in recent years.

For example, a compact antenna apparatus capable of being shared among multiple systems of different frequency bands is disclosed in Japanese Unexamined Patent Application Publication No. 2014-239539. This antenna apparatus includes a radiating element defining and functioning as an electric-field antenna, a ground conductor arranged so as to oppose the radiating element, and an inductance element with which the radiating element is connected to the ground conductor. The radiating element, the inductance element, and the ground conductor are connected in series to each other to define a loop portion. The impedance of the inductance element comes close to an open state in a first frequency band and comes close to a short-circuited state in a second frequency band. Accordingly, the radiating element defines and functions as an electric-field antenna element for the first frequency band and the loop portion defines and functions as an antenna element for the second frequency band.

However, since the large inductance element that does not contribute to coupling with a communication partner antenna is connected in series in the configuration disclosed in Japanese Unexamined Patent Application Publication No. 2014-239539, the ratio of the inductance that contributes to the communication to the inductance of the entire antenna is decreased. Accordingly, the coupling coefficient with the communication partner antenna may be decreased, thus reducing the communication characteristics of the antenna apparatus.

SUMMARY OF THE INVENTION

Preferred embodiments of the present invention provide compact antenna apparatuses that are capable of being shared among multiple systems of different frequency bands and that have excellent communication characteristics with a simple configuration and provide communication terminal apparatuses including one or more of the antenna apparatuses.

A preferred embodiment of the present invention provides an antenna apparatus including a conductive radiating element defining and functioning as a standing-wave antenna, a conductive member, and a first impedance circuit that includes a first parallel resonant circuit and that is directly connected between the radiating element and the conductive member. A loop portion defining and functioning as a magnetic-field radiation antenna, which includes the radiating element, the conductive member, and the first impedance circuit.

With the above configuration, the inclusion of the radiating element defining and functioning as the standing-wave antenna and the loop portion defining and functioning as the magnetic-field radiation antenna enables the antenna apparatus capable of being shared among multiple systems of different frequency bands to be realized.

In addition, since the first impedance circuit includes the first parallel resonant circuit, setting the resonant frequency of the first parallel resonant circuit to a first frequency band produces very high impedance at the set frequency. Accordingly, the inductance of the inductor connected to the loop portion is made low, compared with a case in which an element having high inductance is connected. Consequently, the ratio of the inductance that does not contribute to communication to the inductance of the entire magnetic-field radiation antenna is decreased to suppress a reduction in the coupling coefficient between the magnetic-field radiation antenna and a communication partner antenna. In other words, it is possible to realize the compact antenna apparatus having excellent communication characteristics with a simple configuration.

Standing waves are preferably generated in a first frequency band in the radiating element, and the loop portion preferably resonates in a second frequency band lower than the first frequency band. With this configuration, the compact antenna for the first frequency band and the antenna for the second frequency band are provided.

The first parallel resonant circuit preferably has high impedance in the first frequency band, compared with impedance in the second frequency band. With this configuration, since the first parallel resonant circuit connected between the radiating element and the conductive member comes close to an open state in the first frequency band, the radiating element defines and functions as the antenna element for the first frequency band.

The radiating element may be grounded via a reactance circuit having low impedance in the first frequency band, compared with impedance in the second frequency band in any of the above-described preferred embodiments of the present invention.

The conductive member is preferably grounded via the reactance circuit having low impedance in the first frequency band, compared with the impedance in the second frequency band in any of the above-described preferred embodiments of the present invention. With this configuration, the conductive member is separated from the ground in the second frequency band. Accordingly, the loop portion resonates in the second frequency band without being affected by the ground.

The conductive member preferably includes a ground conductor in above-described preferred embodiments of the present invention. With this configuration, the ground conductor, such as a substrate, is capable of being used as a portion of the antenna. Accordingly, since it is not necessary to separately form or provide the conductive member, the antenna apparatus is easily manufactured at low cost.

The antenna apparatus preferably further includes a second impedance circuit that includes a second parallel resonant circuit and that is directly connected between the radiating element and the conductive member, the second impedance circuit is preferably included in the loop portion, and the second impedance circuit preferably has high impedance in the first frequency band, compared with impedance in the second frequency band in any of the above-described preferred embodiments of the present invention. With this configuration, setting the resonant frequency of the first parallel resonant circuit and the resonant frequency of the second parallel resonant circuit to the first frequency band produces very high impedance at the set frequencies. Accordingly, the radiating element is capable of being reliably separated from the loop portion in the first frequency band, compared with the case in which an inductor and a capacitor are connected. Accordingly, it is easy to design (for example, the width and the length of the radiating element) the radiating element that resonates in the first frequency band to define and function as the standing-wave antenna contributing to electric-field radiation.

The antenna apparatus preferably further includes a power supply coil and the power supply coil is preferably at least magnetically coupled to the loop portion in the second frequency band in any of the above-described preferred embodiments of the present invention. With this configuration, the power supply coil is coupled to the loop portion and the loop portion defines and functions as a booster antenna for the power supply coil in the second frequency band. Accordingly, the effective coil opening functioning as an antenna is increased in size and the range and the distance in which the magnetic flux is radiated (collected) is increased, compared with a case in which only the power supply coil is used, thus making the coupling with the coil of the communication partner antenna easier. Consequently, it is possible to realize the antenna apparatus having excellent communication characteristics with a simple configuration without using the large-size antenna coil.

The first impedance circuit is preferably connected near or adjacent to a first end portion in the long-side direction of the radiating element in any of the above-described preferred embodiments of the present invention. With this configuration, the effective coil opening of the loop portion defining and functioning as the magnetic-field radiation antenna, which includes the radiating element, the conductive member, and the first impedance circuit, is increased in size and the range and the distance in which the magnetic flux is radiated (collected) is increased, thus making the coupling with the coil of the communication partner antenna easier. Accordingly, it is possible to realize the antenna apparatus having excellent communication characteristics with a simple configuration without using the large-size antenna coil.

Another preferred embodiment of the present invention provides a communication terminal apparatus including the antenna apparatus described in any of the above-described preferred embodiments of the present invention and a housing. The radiating element is preferably a first conductor that is defined by a portion of the housing or that is held in the housing.

With this configuration, the use of the first conductor that is defined by a portion of the housing or that is held in the housing enables the radiating element defining and functioning as the magnetic-field radiation antenna to be easily provided. Accordingly, since it is not necessary to separately form or provide the radiating element, the communication terminal apparatus is easily manufactured at low cost.

A preferred embodiment of the present invention provides a communication terminal apparatus including the antenna apparatus described in any of the above-described preferred embodiments of the present invention and a housing. The conductive member is preferably a second conductor that is defined by a portion of the housing or that is held in the housing.

With this configuration, the use of the second conductor that is defined by a portion of the housing or that is held in the housing enables the radiating element to be easily provided. Accordingly, since it is not necessary to separately form or provide the conductive member, the communication terminal apparatus is easily manufactured at low cost.

According to various preferred embodiments of the present invention, it is possible to realize compact antenna apparatuses that are capable of being shared among multiple systems of different frequency bands and that have excellent communication characteristics with a simple configuration. In addition, it is possible to realize communication terminal apparatuses including one or more of the antenna apparatuses.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
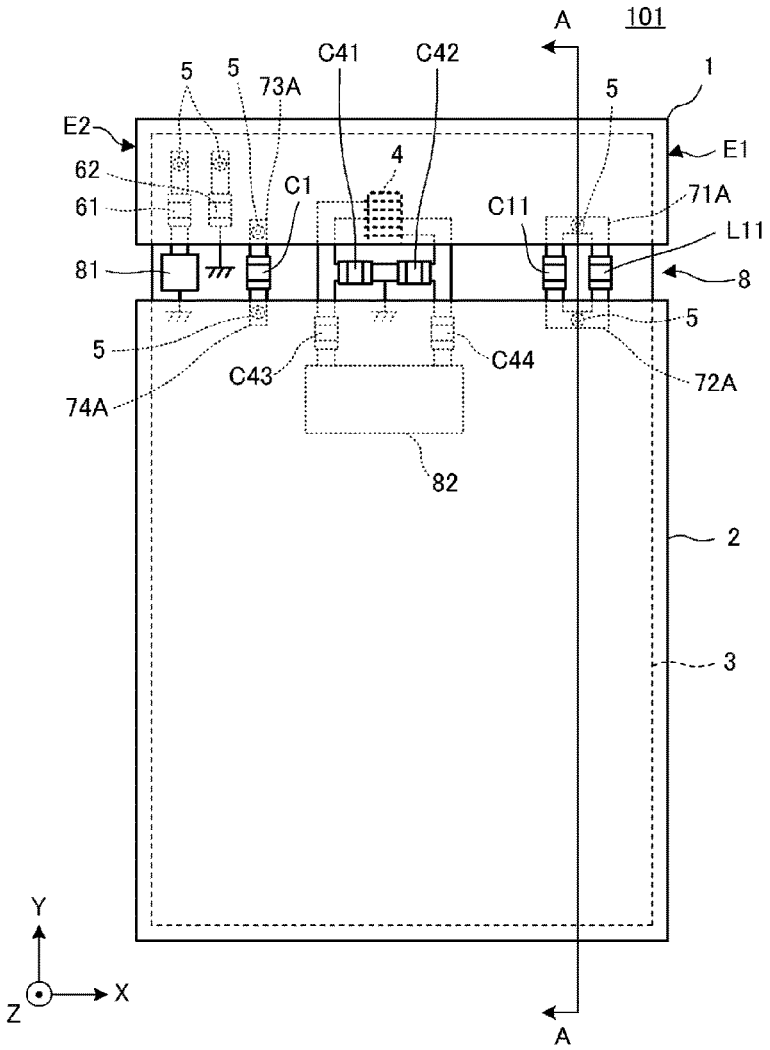
FIG. 1A is a plan view of an antenna apparatus 101 according to a first preferred embodiment of the present invention and FIG. 1B is a cross-sectional view in FIG. 1A, taken along an A-A line.

Multiple preferred embodiments of the present invention will herein be described with reference to the drawings while giving specific examples. The same reference numerals and symbols are used to identify the same components in the drawings. The preferred embodiments of the present invention are only examples and components described in different preferred embodiments may be partially replaced or combined with each other.

Antenna apparatuses of the preferred embodiments described below are each provided in a communication terminal or the like, which is represented by a smartphone or a tablet terminal. The antenna apparatus is capable of being shared among multiple systems (a global positioning system (GPS), a Wi-Fi (registered trademark) system, and a near field communication (NFC) system) of different frequency bands, such as a high frequency (HF) band, an ultra high frequency (UHF) band, and a super high frequency (SHF) band.

First Preferred Embodiment

Figure 1B:
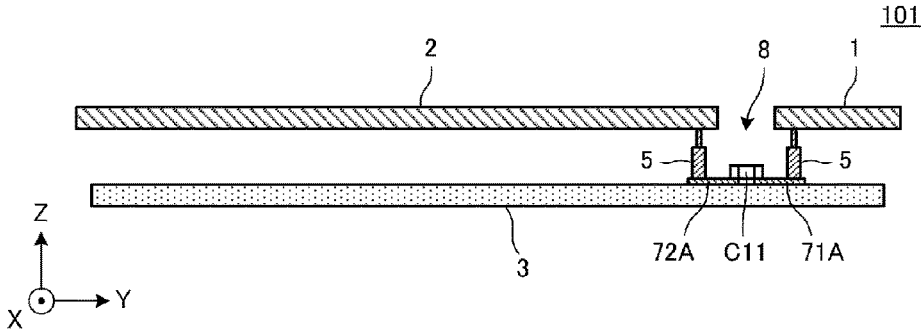
Figure 2:
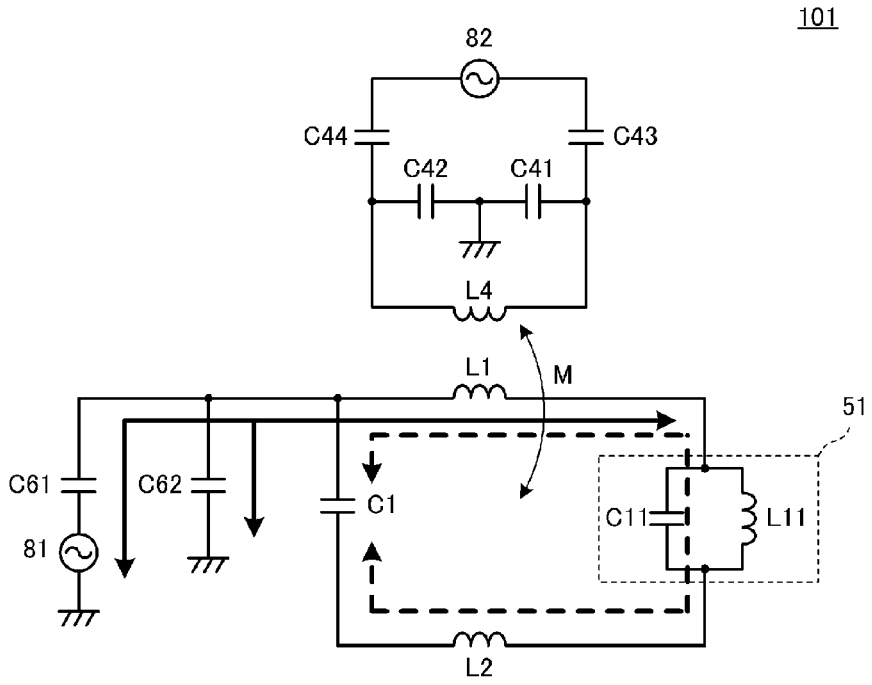
FIG. 2 is an equivalent circuit diagram of lumped elements in the antenna apparatus 101.

FIG. 1A is a plan view of an antenna apparatus 101 according to a first preferred embodiment of the present invention. FIG. 1B is a cross-sectional view in FIG. 1A, taken along an A-A line. The thickness of each component is exaggeratedly illustrated in FIG. 1B. The same applies to the cross-sectional views in the preferred embodiments described below. FIG. 2 is an equivalent circuit diagram of lumped elements in the antenna apparatus 101. Referring to FIG. 2 and FIG. 3B, a radiating element 1 is represented by an inductor L1, a conductor plate 2 (a conductive member) is represented by an inductor L2, and a power supply coil is represented by an inductor L4. The same applies to the equivalent circuit diagrams in the preferred embodiments described below.

The antenna apparatus 101 includes the radiating element 1, the conductor plate 2, a substrate 3, a first impedance circuit 51, a capacitor C1, a first power supply circuit 81, a second power supply circuit 82, reactance elements 61 and 62, and capacitors C41, C42, C43, and C44.

The first impedance circuit 51, the capacitor C1, the first power supply circuit 81, the second power supply circuit 82, the reactance elements 61 and 62, and the capacitors C41, C42, C43, and C44 are mounted on the substrate 3. Each of the capacitors C41, C42, C43, and C44 is a capacitor component, such as a chip capacitor.

Each of the radiating element 1 and the conductor plate is a conductive flat plate preferably with a rectangular or substantially rectangular planar shape. The radiating element 1 and the conductor plate 2 in the present preferred embodiment are arranged in the longitudinal direction (the Y direction in FIG. 1A) with a gap 8 disposed therebetween and are arranged on the same plane (refer to FIG. 1B). The long-side direction of the radiating element 1 coincides with the lateral direction (the X direction in FIG. 1A). The radiating element 1 includes a first end portion E1 and a second end portion E2 on both sides in the long-side direction.

The radiating element 1 and the conductor plate 2 are defined by a portion of a rear-side housing of, for example, a smartphone. In the present preferred embodiment, the radiating element 1 corresponds to a "first conductor". In the present preferred embodiment, the conductor plate 2 corresponds to a "conductive member" and corresponds to a "second conductor". Each of the first conductor and the second conductor is a conductive member and is made of, for example, metal or graphite.

The first impedance circuit 51 includes a first parallel resonant circuit (an LC parallel resonant circuit) and is directly connected between the radiating element 1 and the conductor plate 2. The first impedance circuit 51 includes an inductor L11 and a capacitor C11 and is connected near the first end portion E1 in the long-side direction of the radiating element 1. Connection conductors 71A and 72A are U-shaped conductive patterns located on a main surface of the substrate 3. The connection conductor 71A is connected to one end of the inductor L11 and one end of the capacitor C11 and is connected to the radiating element 1 using a connection pin 5. The connection conductor 72A is connected to the other end of the inductor L11 and the other end of the capacitor C11 and is connected to the conductor plate 2 using a connection pin 5. In other words, one end of each of the inductor L11 and the capacitor C11 is connected to the radiating element 1 via the connection conductor 71A and the connection pin 5. The other end of each of the inductor L11 and the capacitor C11 is connected to the conductor plate 2 via the connection conductor 72A and the connection pin 5. The inductor L11 is, for example, an inductor component, such as a chip inductor. The connection pin 5 is, for example, a movable probe pin.

In the above configuration, the first impedance circuit 51 in the present preferred embodiment includes the LC parallel resonant circuit including the inductor L11 and the capacitor C11. In the present preferred embodiment, the LC parallel resonant circuit corresponds to the "first parallel resonant circuit".

The capacitor C1 is connected between the radiating element 1 and the conductor plate 2 via connection conductors 73A and 74A located on the main surface of the substrate 3 and connection pins 5.

Accordingly, as illustrated in FIG. 1A, a loop portion including the radiating element 1, the conductor plate 2, the first impedance circuit 51, and the capacitor C1 is provided.

The first power supply circuit 81 is an integrated circuit (IC) for the UHF band or the SHF band (a first frequency band). An input-output portion of the first power supply circuit 81 is connected near the second end portion E2 in the long-side direction of the radiating element 1 via a connection conductor located on the main surface of the substrate 3, a connection pin 5, and the reactance element 61. The reactance element 61 is, for example, an electronic component, such as a chip capacitor. The first power supply circuit 81 is a power supply circuit for, for example, a 2.4-GHz wireless LAN communication system.

Connection of the radiating element 1 including the reactance element 62 to ground is a stub provided to match between the antenna including the radiating element 1 and the first power supply circuit 81 for another communication system. The reactance element 62 is connected near the second end portion E2 in the long-side direction of the radiating element 1 via a connection conductor located on the main surface of the substrate 3 and a connection pin 5. The reactance element 62 is, for example, an electronic component, such as a chip capacitor. A configuration in which multiple reactance elements 62 are provided if needed may be adopted. However, the reactance element 62 is not an essential component and a configuration in which the stub is not provided may be adopted.

The second power supply circuit 82 is a balanced input-output IC for the HF band (a second frequency band). The power supply coil 4 is connected to an input-output portion of the second power supply circuit 82 with the capacitors C41, C42, C43, and C44 interposed therebetween. The power supply coil 4 is, for example, a multilayer ferrite chip antenna in which a coil conductor is wound around a ferrite core. The power supply coil 4 is arranged, in a plan view, at a position that is near the center in the long-side direction (the X direction in FIG. 1) of the radiating element 1 so that a coil opening of the power supply coil 4 is along an edge portion of the radiating element 1, which faces the gap 8. In other words, the coil opening of the power supply coil 4 is arranged so as to face the conductor plate 2. The second power supply circuit 82 is, for example, a radio frequency integrated circuit (RFIC) element for 13.56-MHz radio frequency identification (RFID).

A series circuit including the capacitors C41 and C42 is connected in parallel to the power supply coil 4 to provide an LC resonant circuit. The second power supply circuit 82 supplies a communication signal in the HF band to the LC resonant circuit via the capacitors C43 and C44. The power supply coil 4 is magnetically coupled to the loop portion including the radiating element 1, the conductor plate 2, the first impedance circuit 51, and the capacitor C1.

Figure 3A:
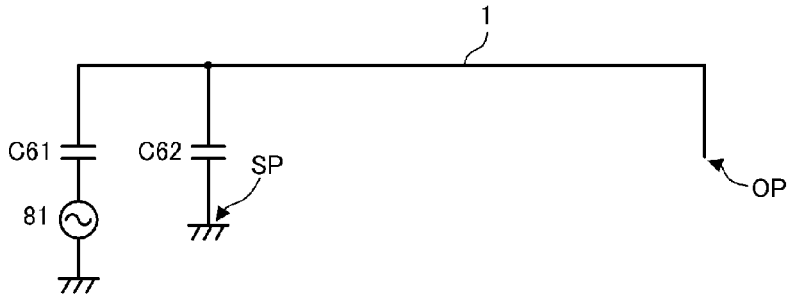
FIG. 3A is an equivalent circuit diagram of the antenna apparatus 101 in an UHF band or an SHF band and FIG. 3B is an equivalent circuit diagram of the antenna apparatus 101 in an HF band.
Figure 3B:
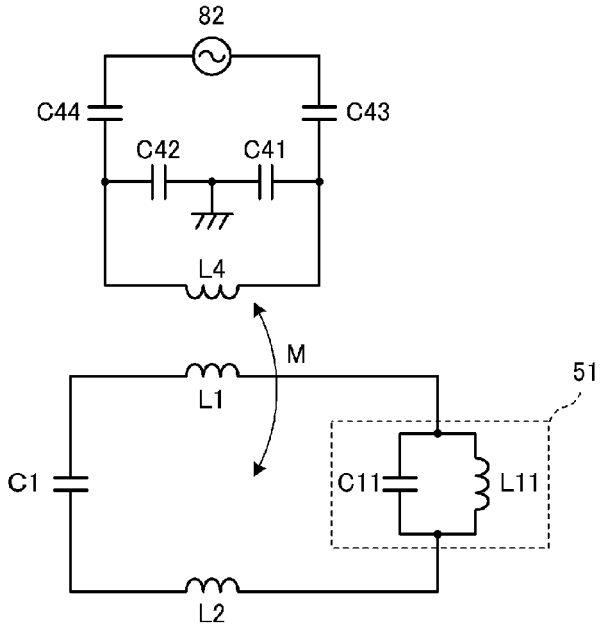

FIG. 3A is an equivalent circuit diagram of the antenna apparatus 101 in the UHF band or the SHF band. FIG. 3B is an equivalent circuit diagram of the antenna apparatus 101 in the HF band. Referring to FIG. 3A, the reactance elements 61 and 62 are represented by capacitors C61 and C62, respectively.

In the UHF band or the SHF band (the first frequency band), the capacitor C62 has low impedance and is equivalently in a short-circuited state. Accordingly, the radiating element 1 is grounded at a certain position, as illustrated by a grounded end SP in FIG. 3A. The LC parallel resonant circuit (the first parallel resonant circuit) including the inductor L11 and the capacitor C11 has high impedance in the UHF band or the SHF band (the first frequency band) and is equivalently in an open state. Accordingly, one end of the radiating element 1 is opened, as illustrated by an open end OP in FIG. 3A.

The first power supply circuit 81 supplies voltage using a connection point with the radiating element 1 as a power supply point. The radiating element 1 resonates so as to have a current intensity of zero at the open end OP and have an electric field strength of zero at the grounded end SP in the UHF band or the SHF band (the first frequency band). In other words, the length and so on of the radiating element 1 are set so that the radiating element 1 resonates in the UHF band or the SHF band. However, the radiating element 1 resonates in a fundamental mode in a low band in a frequency band from 700 MHz to 2.4 GHz and resonates in a higher order mode in a high band therein. Accordingly, current flows through the antenna apparatus 101 in an area indicated by a solid-line arrow in FIG. 2 in the UHF band or the SHF band (the first frequency band).

The radiating element 1 defines and functions as a standing-wave inverted F antenna that contributes to radiation of electromagnetic waves for far field communication in the above manner in the UHF band or the SHF band (the first frequency band) and resonates to generate standing waves of the current intensity and the electric field strength. Although the inverted F antenna is exemplified here, another standing-wave antenna, such as a monopole antenna, a one-wavelength loop antenna, an inverted L antenna, a patch antenna such as a planar inverted F antenna (PIFA), a slot antenna, or a notch antenna, which resonates on the radiating element to generate standing waves of the current intensity and the electric field strength, is also applicable to the radiating element 1.

In contrast, in the HF band (the second frequency band), the loop portion including the radiating element 1, the first impedance circuit 51, the conductor plate 2, and the capacitor C1 defines an LC resonant circuit, as illustrated in FIG. 3B. The power supply coil 4 is magnetically coupled to the loop portion of the LC resonant circuit, as described above.

The loop portion LC-resonates in the HF band and resonance current flows along edges of the radiating element 1 and the conductor plate 2. In other words, the length of the radiating element 1 and the circuit constants of, for example, reactance components of the first impedance circuit 51 and the capacitor C1 are set so that the loop portion resonates in the HF band. Accordingly, current flows through the antenna apparatus 101 in an area indicated by a broken-line arrow in FIG. 2 in the HF band (the second frequency band).

The loop portion including the radiating element 1, the first impedance circuit 51, the conductor plate 2, and the capacitor C1 defines and functions as a magnetic-field radiation antenna that contributes to magnetic-field radiation for neighborhood communication in the above manner in the HF band (the second frequency band). Since the length of the loop portion (the length around the loop portion) is sufficiently shorter than the wavelength and is preferably about 1/10 or less of the wavelength in the HF band (the second frequency band), for example, the loop portion is a minute loop antenna for communication using magnetic field coupling. Since the length of the loop portion is sufficiently shorter than the wavelength in the HF band (the second frequency band), radiation resistance is low and it is difficult for the loop portion to radiate the electromagnetic waves in the HF band (the second frequency band).

Since the reactance elements 61 and 62 have high impedance in the HF band (the second frequency band) and is in a state in which the first power supply circuit 81 is not equivalently connected, the communication in the HF band is not affected by the first power supply circuit 81. The first parallel resonant circuit has high impedance in the UHF band or the SHF band (the first frequency band) and is in a state in which the first impedance circuit 51 (the first parallel resonant circuit) is not equivalently connected. Accordingly, since the loop portion including the first impedance circuit 51 is in the open state, no communication signal in the UHF band or the SHF band flows through the second power supply circuit 82 and the communication in the UHF band or the SHF band is not affected by the second power supply circuit 82.

Figure 4A:
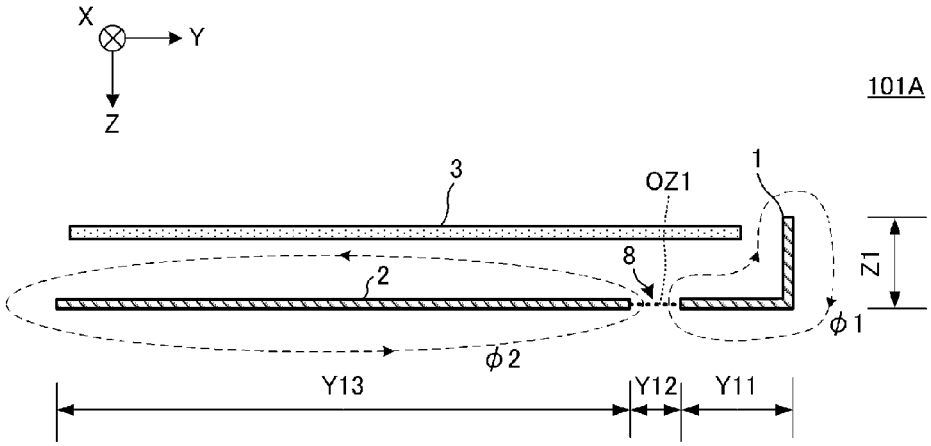
FIG. 4A is a cross-sectional view of an antenna apparatus 101A and FIG. 4B is a cross-sectional view of the antenna apparatus 101A, which indicates the density of magnetic flux generated from a radiating element 1 and a conductor plate 2 in the HF band.
Figure 4B:
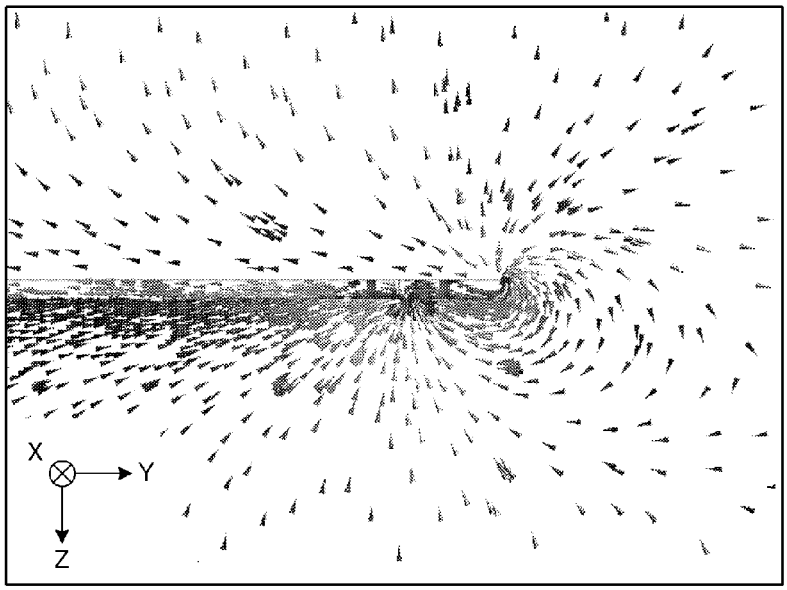

Magnetic fields generated from the radiating element 1 and the conductor plate 2 in the HF band (the second frequency band) will now be described with reference to the drawings. FIG. 4A is a cross-sectional view of an antenna apparatus 101A. FIG. 4B is a cross-sectional view of the antenna apparatus 101A, which indicates the density of magnetic flux generated from the radiating element 1 and the conductor plate 2 in the HF band.

The antenna apparatus 101A differs from the antenna apparatus 101 according to the present preferred embodiment in that the radiating element 1 is not a flat plate and preferably has an L-shaped or substantially L-shaped cross-sectional shape, for example. The remaining configuration of the antenna apparatus 101A is substantially the same as that of the antenna apparatus 101 according to the present preferred embodiment.

Referring to FIG. 4A, the dimensions of portions preferably are as follows:

Y11: about 10 mm
Y12: about 2 mm
Y13: about 11.5 mm
Z1: about 2 mm As illustrated in FIGS. 4A and 4B, both magnetic flux $\phi$1 generated around the radiating element 1 and magnetic flux $\phi$2 generated around the conductor plate 2 pass through the gap 8. Accordingly, the loop portion including the radiating element 1, the conductor plate 2, the first impedance circuit 51, and the capacitor defines and functions as a booster antenna.

The following advantages are achieved in the present preferred embodiment.

The provision of the radiating element 1 defining and functioning as the standing-wave antenna and the loop portion defining and functioning as the magnetic-field radiation antenna in the antenna apparatus 101 enables the antenna apparatus capable of being shared among multiple systems of different frequency bands to be realized.

Since the first impedance circuit 51 includes the first parallel resonant circuit, setting the resonant frequency of the first parallel resonant circuit to the UHF band or the SHF band (the first frequency band) produces very high impedance at the set frequency. Accordingly, the inductance of the inductor L11 connected to the loop portion is made low, compared with a case in which an element having high inductance is connected. Consequently, the ratio of the inductance that does not contribute to the communication to the inductance of the entire magnetic-field radiation antenna is decreased to suppress a reduction in the coupling coefficient between the magnetic-field radiation antenna and a communication partner antenna. In other words, it is possible to realize the compact antenna apparatus having excellent communication characteristics with a simple configuration.

In the antenna apparatus 101, the power supply coil 4 is magnetically or electromagnetically coupled (electric field coupling and magnetic field coupling) to the loop portion and the loop portion defines and functions as a booster antenna for the power supply coil 4 in the HF band (the second frequency band). Accordingly, the effective coil opening defining and functioning as an antenna is increased in size and the range and the distance in which the magnetic flux is radiated (collected) is increased, compared with a case in which only the power supply coil 4 is used, thus making the coupling with the coil of the communication partner antenna easier. Consequently, it is possible to realize the antenna apparatus having excellent communication characteristics with a simple configuration without using the large-size antenna coil.

Since the second power supply circuit 82 in the HF band (the second frequency band) is not directly connected to the radiating element 1 in the antenna apparatus 101, the degree of freedom of the positions where the power supply coil 4 and the second power supply circuit 82 are mounted is high and the conductive pattern located on the main surface of the substrate 3 is simplified.

Since a portion of the housing is used for the radiating element 1 and the conductor plate 2 in the antenna apparatus 101, the radiating element of the magnetic-field radiation antenna is easily configured. Accordingly, it is not necessary to separately form the radiating element and the conductive member and the antenna apparatus 101 is easily manufactured at low cost.

In the present application, the "standing-wave antenna" means an antenna that resonates on the radiating element and that radiates the electromagnetic waves through distribution of the standing waves of voltage and current. In the present application, the "magnetic-field radiation antenna" means an antenna the loop portion of which contributes to the magnetic-field radiation.

The "standing-wave antenna" in the present preferred embodiment means an antenna in which the radiating element 1 resonates so as to have a current intensity of zero at the open end OP and have an electric field strength of zero at the grounded end SP in the UHF band or the SHF band (the first frequency band) to generate the standing waves. The "magnetic-field radiation antenna" in the present preferred embodiment means an antenna in which the loop portion defining an LC resonant circuit resonates in the HF band (the second frequency band) to contribute to the magnetic-field radiation.

"Near the first end portion" of the radiating element 1 in the present application does not only mean very close to the edge portion in the long-side direction (the X direction) of the radiating element 1. "Near the first end portion" of the radiating element 1 means a range in which the loop portion defines and functions as the magnetic-field radiation antenna that contributes to the magnetic-field radiation to ensure the opening area enabling the magnetic field coupling with the communication partner antenna. For example, a range in the lateral direction (the X direction) from the first end portion of the radiating element 1 to about ⅓ of the length of the radiating element 1 in the lateral direction, for example, is referred to as "near the first end portion".

"Near the second end portion" of the radiating element 1 in the present preferred embodiment does not only mean very close to the edge portion in the long-side direction (the X direction) of the radiating element 1. "Near the second end portion" of the radiating element 1 means a range in which the loop portion defines and functions as the magnetic-field radiation antenna that contributes to the magnetic-field radiation to ensure the opening area enabling the magnetic field coupling with the communication partner antenna. In the present preferred embodiment, for example, a range in the lateral direction (the X direction) from the second end portion of the radiating element 1 to about ⅓ of the length of the radiating element 1 in the lateral direction, for example, is referred to as "near the second end portion".

Although the example of the antenna apparatus 101 is described in the present preferred embodiment in which the radiating element 1 and the conductor plate 2 (the conductive member) are arranged on the same plane (having the same height in the Z direction), the antenna apparatus 101 is not limited to this configuration. The relationship in height in the Z direction between the radiating element 1 and the conductor plate 2 (the conductive member) may be appropriately varied within a range in which the effects and the advantages of the inclusion of the radiating element 1 defining and functioning as the standing-wave antenna and the loop portion defining and functioning as the magnetic-field radiation antenna are achieved. Varying the relationship in height in the Z direction between the radiating element 1 and the conductive member varies the directivity of the antenna, as described below.

Although the example is described in the present preferred embodiment in which the first impedance circuit 51 is connected near the first end portion E1 in the long-side direction of the radiating element 1 and the capacitor C1 is connected near the second end portion E2, this configuration is not limitedly adopted. The positions of connection portions (in the X direction and the Y direction) may be appropriately varied as long as the loop portion is capable of being provided and the radiating element 1 is capable of functioning as the standing-wave antenna. However, the antenna having more excellent communication characteristics at the loop portion in the HF band is realized in a case in which the connection portions are near the end portions, as described below.

Although the example is described in the present preferred embodiment in which the first impedance circuit 51 is connected near the first end portion in the long-side direction of the radiating element 1 and the capacitor C1 is connected near the second end portion in the long-side direction of the radiating element 1, this configuration is not limiting on preferred embodiments of the present invention. A configuration may be adopted in which the first impedance circuit 51 is connected near the second end portion in the long-side direction of the radiating element 1 and the capacitor C1 is connected near the first end portion in the long-side direction of the radiating element 1. In other words, the position of the circuit or the reactance element connected near the first end portion in the long-side direction of the radiating element 1 may be replaced with the position of the circuit or the reactance element connected near the second end portion in the long-side direction of the radiating element 1 as long as the loop portion is capable of being provided. The same applies to the other preferred embodiments described below. However, when the position of the circuit or the reactance element connected near the first end portion in the long-side direction of the radiating element 1 is replaced with the position of the circuit or the reactance element connected near the second end portion in the long-side direction of the radiating element 1, the antenna characteristics of the standing-wave antenna are varied.

Although the example is described in the present preferred embodiment in which the radiating element 1 and the conductor plate 2 are defined by a portion of the rear-side housing of, for example, a smartphone, this configuration is not limiting on preferred embodiments of the present invention. Conductors provided in the housing of the smartphone or the like may be used as the radiating element 1 and the conductor plate 2.

Although the example is described in the present preferred embodiment in which the power supply coil 4 is at least magnetically coupled to the loop portion separated from the power supply coil 4 to electrically connect the power supply coil 4 to the loop portion, this configuration is not limitedly adopted. A conductor defined by a portion of the loop portion (for example, a coil-shaped conductive pattern) and the power supply coil may be provided in one insulator and the conductor and the power supply coil may be an integrated component defining and functioning as a transformer element. In addition, since the second power supply circuit 82 is connected to the loop portion at least through the magnetic field coupling, the second power supply circuit 82 is capable of supplying electric power to the loop portion regardless of whether the loop portion and the second power supply circuit 82 are balanced circuits or unbalanced circuits.

Second Preferred Embodiment

Figure 5A:
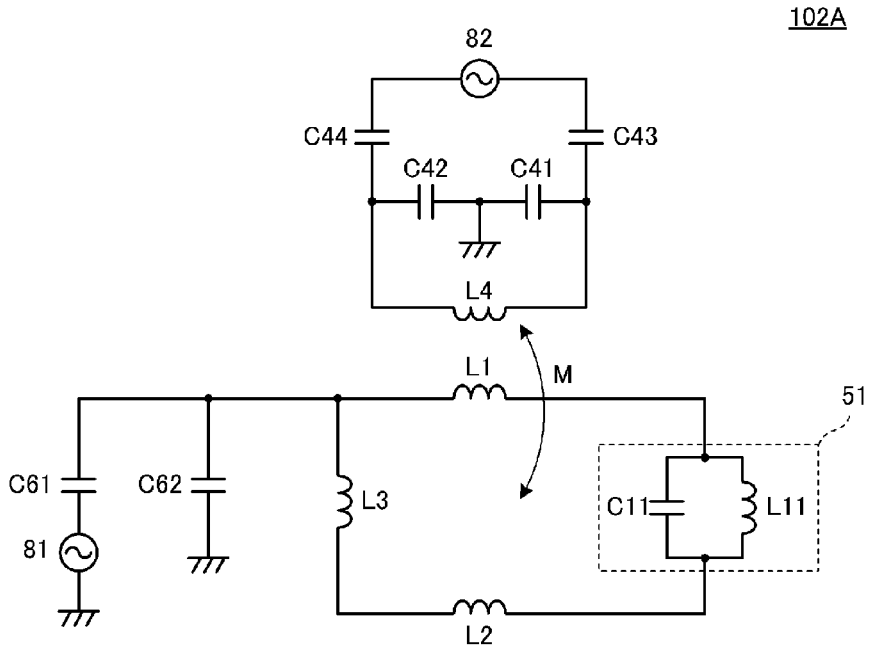
FIG. 5A is an equivalent circuit diagram of lumped elements in an antenna apparatus 102A according to a second preferred embodiment of the present invention and FIG. 5B is an equivalent circuit diagram of lumped elements in an antenna apparatus 102B.
Figure 5B:
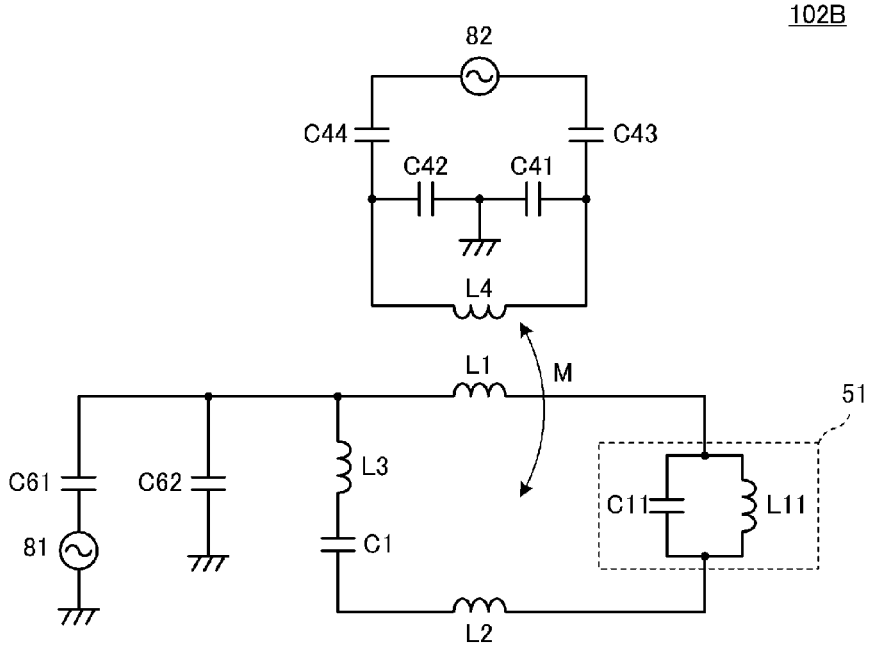
Figure 6A:
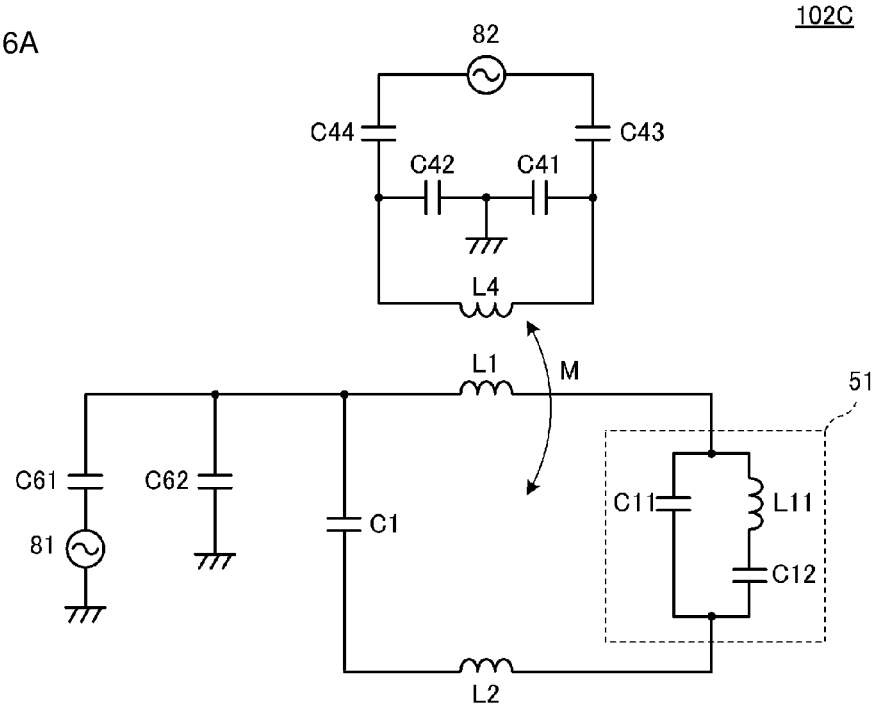
FIG. 6A is an equivalent circuit diagram of lumped elements in an antenna apparatus 102C according to the second preferred embodiment of the present invention and FIG. 6B is an equivalent circuit diagram of lumped elements in an antenna apparatus 102D.
Figure 6B:
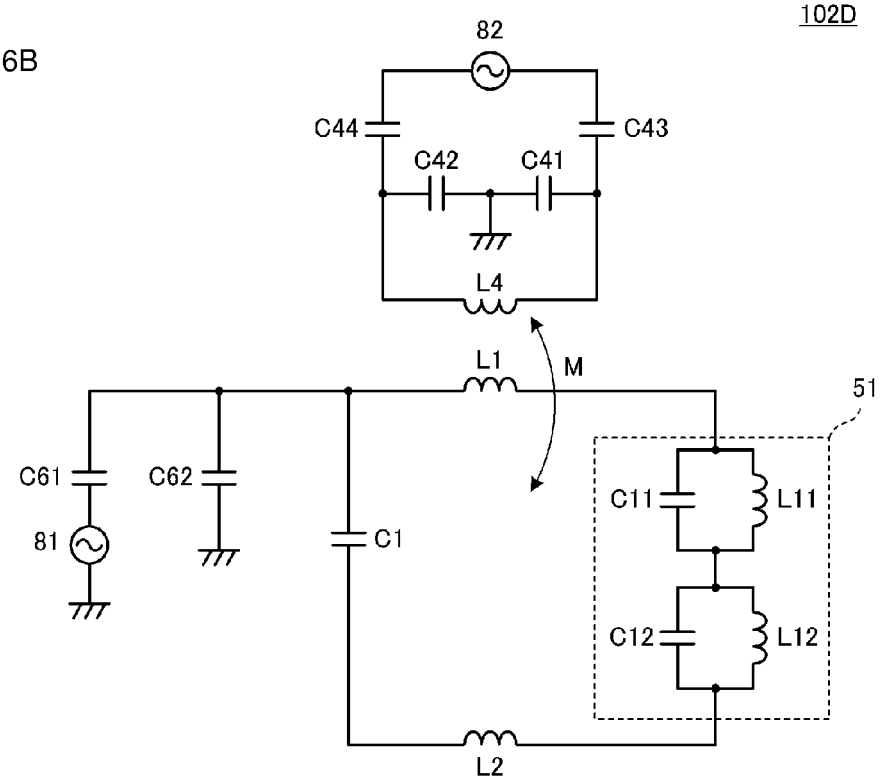

FIG. 5A is an equivalent circuit diagram of lumped elements in an antenna apparatus 102A according to a second preferred embodiment of the present invention. FIG. 5B is an equivalent circuit diagram of lumped elements in an antenna apparatus 102B. FIG. 6A is an equivalent circuit diagram of lumped elements in an antenna apparatus 102C according to the second preferred embodiment. FIG. 6B is an equivalent circuit diagram of lumped elements in an antenna apparatus 102D.

The antenna apparatus 102A according to the second preferred embodiment differs from the antenna apparatus 101 in that not the capacitor but an inductor L3 is connected between the radiating element and the conductor plate. The remaining configuration of the antenna apparatus 102A is the same as that of the antenna apparatus 101 according to the first preferred embodiment. The inductor L3 is, for example, an inductor component, such as a chip inductor.

The antenna apparatus 102B according to the second preferred embodiment differs from the antenna apparatus 101 in that not the capacitor but the inductor L3 and the capacitor C1, which are connected in series to each other, are connected between the radiating element and the conductor plate. The remaining configuration of the antenna apparatus 102B is the same as that of the antenna apparatus 101 according to the first preferred embodiment.

The antenna apparatus 102C according to the second preferred embodiment differs from the antenna apparatus 101 in the configuration of the first impedance circuit 51. The remaining configuration of the antenna apparatus 102C is the same as that of the antenna apparatus 101 according to the first preferred embodiment.

The first impedance circuit 51 in the antenna apparatus 102C includes the inductor L11, the capacitor C11, and a capacitor C12, as illustrated in FIG. 6A. The inductor L11 is connected in series to the capacitor C12. One end of the inductor L11 and one end of the capacitor C11 are connected to the radiating element and the other end of the capacitor C11 and the other end of the capacitor C12 are connected to the conductor plate. The first impedance circuit 51 includes an LC parallel resonant circuit including the inductor L11 and the capacitors C11 and C12. In the antenna apparatus 102C, this LC parallel resonant circuit corresponds to the "first parallel resonant circuit".

The antenna apparatus 102D according to the second preferred embodiment differs from the antenna apparatus 101 in the configuration of the first impedance circuit 51. The remaining configuration of the antenna apparatus 102D is the same as that of the antenna apparatus 101 according to the first preferred embodiment.

The first impedance circuit 51 in the antenna apparatus 102D includes the inductor L11, an inductor L12, and the capacitors C11 and C12, as illustrated in FIG. 6B. The inductor L11 and the capacitor C11 define an LC parallel circuit and the inductor L12 and the capacitor C12 define an LC parallel circuit. These two LC parallel circuits are connected in series to each other.

More specifically, one end of the inductor L11 and one end of the capacitor C11 are connected to the radiating element. The other end of the inductor L11 and the other end of the capacitor C11 are connected to one end of the inductor L12 and one end of the capacitor C12, respectively. The other end of the inductor L12 and the other end of the capacitor C12 are connected to the conductor plate. At least one of the two LC parallel circuits defines an LC parallel resonant circuit.

Also in the above configuration, the basic configurations of the antenna apparatuses 102A, 102B, 102C, and 102D are the same as the configuration of the antenna apparatus 101 according to the first preferred embodiment and the same effects and advantages as those of the antenna apparatus 101 are achieved.

When the inductor L3 is connected in series to the capacitor C1, as illustrated in the antenna apparatus 102B, it is preferred that the inductor L3 and the capacitor C1 define an LC series resonant circuit and the resonant frequency of the LC series resonant circuit be set to the HF band (the second frequency band). Since the LC series resonant circuit has very low impedance in the HF band (the second frequency band) in this configuration, the inductance of the inductor L3 connected to the loop portion is set to a lower value, compared with the case in which only the inductor L3 is connected. Accordingly, the ratio of the inductance that does not contribute to the communication to the inductance of the entire magnetic-field radiation antenna is decreased to suppress a reduction in the coupling coefficient between the magnetic-field radiation antenna and a communication partner antenna. In other words, it is possible to realize the antenna apparatus having excellent communication characteristics.

The first parallel resonant circuit in the first impedance circuit 51 is not limited to the configuration including the inductor L11 and the capacitor C11, as illustrated in the antenna apparatus 102C. The reactance elements used in the configuration of the first parallel resonant circuit may be appropriately varied as long as the LC parallel resonant circuit (anti-resonant circuit) is within the UHF band or the SHF band (the first frequency band).

The first impedance circuit 51 may have the configuration in which multiple LC parallel circuits are connected in series to each other as long as at least one of the LC parallel circuits defines an LC parallel resonant circuit (the first parallel resonant circuit), as illustrated in the antenna apparatus 102D.

When all of the multiple LC parallel circuits connected in series to each other define LC parallel resonant circuits in the first impedance circuit 51, a configuration may be adopted in which the resonant frequency is set for each LC parallel resonant circuit. For example, the resonant frequency of a first-stage LC parallel resonant circuit is set to a 1.5-GHz band (for the GPS), the resonant frequency of a second-stage LC parallel resonant circuit is set to a 2.4-GHz band (for the wireless LAN), and a third-stage LC parallel resonant circuit is set to 5 GHz (for the wireless LAN). The loop portion is equivalently in the open state in multiple frequency bands in the UHF band or the SHF band (the first frequency band) in this configuration. Accordingly, the radiating element defines and functions as the standing-wave antenna to support multiple systems of different frequency bands including the UHF band and the SHF band.

Third Preferred Embodiment

Figure 7:
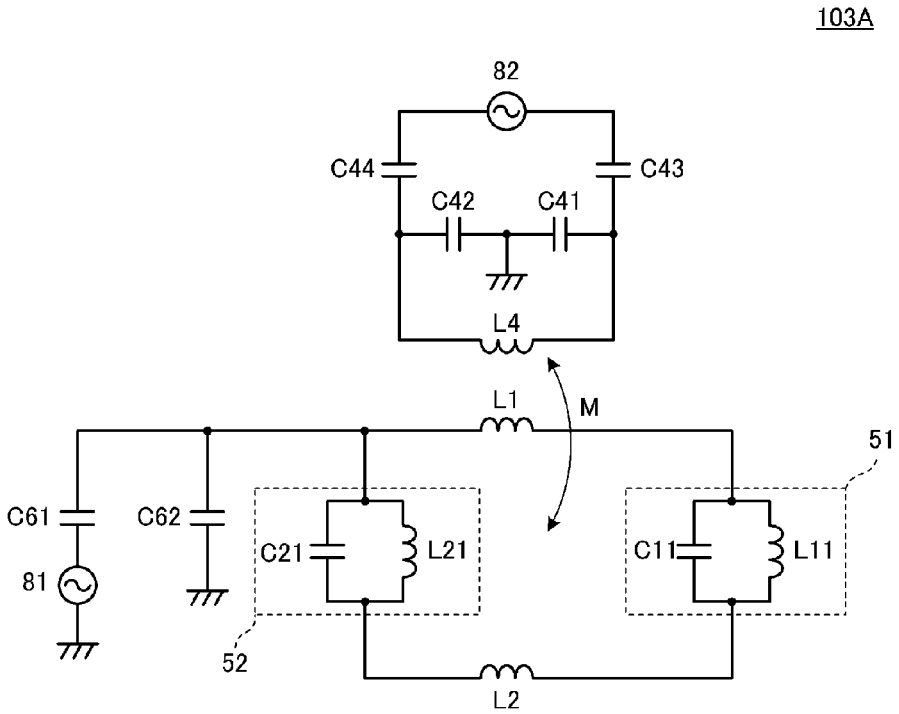
FIG. 7 is an equivalent circuit diagram of lumped elements in an antenna apparatus 103A according to a third preferred embodiment of the present invention.
Figure 8:
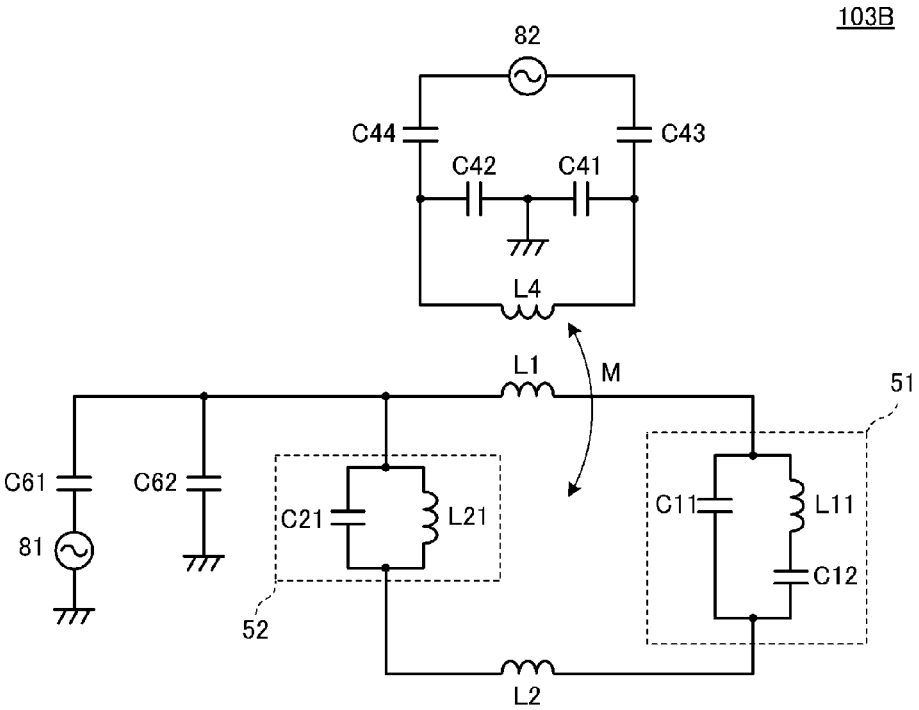
FIG. 8 is an equivalent circuit diagram of lumped elements in an antenna apparatus 103B.
Figure 9:
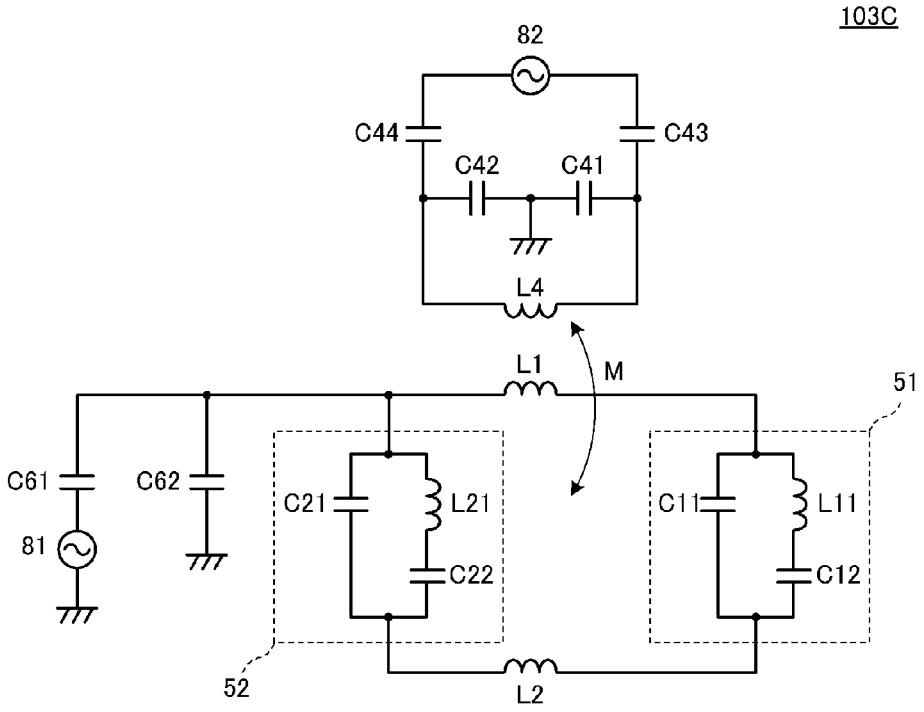
FIG. 9 is an equivalent circuit diagram of lumped elements in an antenna apparatus 103C.
Figure 10:
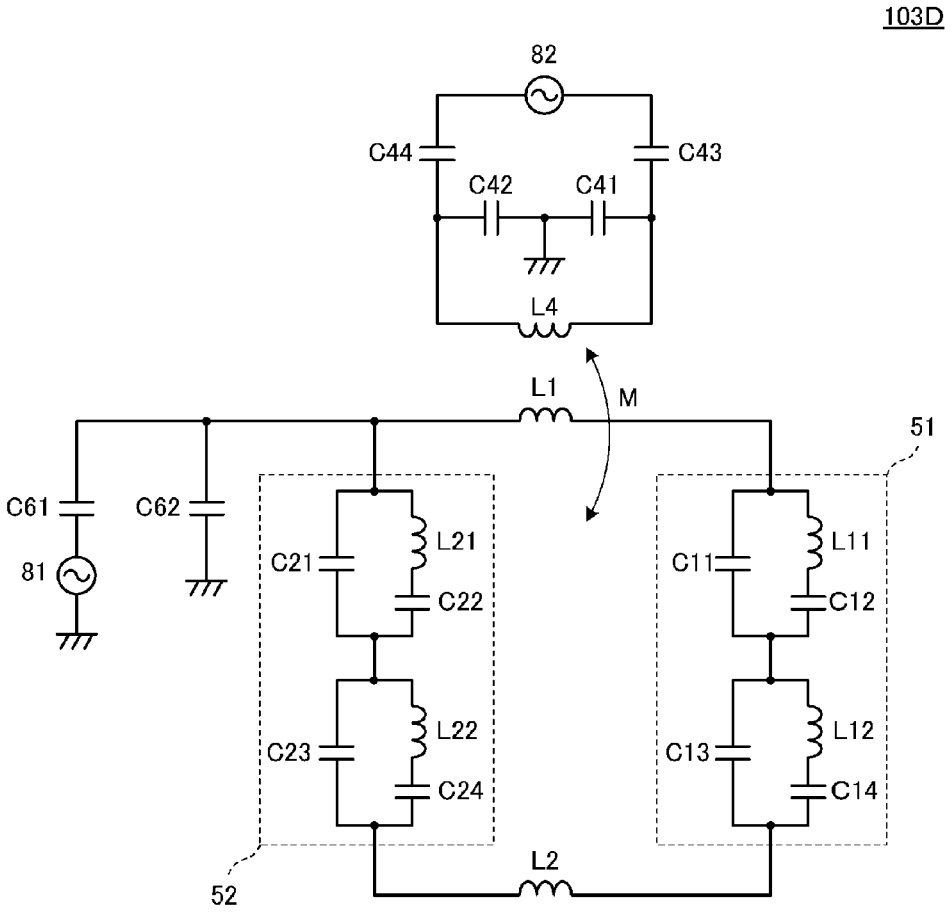
FIG. 10 is an equivalent circuit diagram of lumped elements in an antenna apparatus 103D.

FIG. 7 is an equivalent circuit diagram of lumped elements in an antenna apparatus 103A according to a third preferred embodiment of the present invention. FIG. 8 is an equivalent circuit diagram of lumped elements in an antenna apparatus 103B. FIG. 9 is an equivalent circuit diagram of lumped elements in an antenna apparatus 103C. FIG. 10 is an equivalent circuit diagram of lumped elements in an antenna apparatus 103D.

The antenna apparatus 103A according to the third preferred embodiment differs from the antenna apparatus 101 in that not the capacitor but a second impedance circuit 52 is connected between the radiating element and the conductor plate. The remaining configuration of the antenna apparatus 103A is the same as that of the antenna apparatus 101 according to the first preferred embodiment.

The second impedance circuit 52 in the antenna apparatus 103A includes an inductor L21 and a capacitor C21. One end of the inductor L21 and one end of the capacitor C21 are connected to the radiating element, and other end of the inductor L21 and the other end of the capacitor C21 are connected to the conductor plate. The second impedance circuit 52 includes an LC parallel resonant circuit including the inductor L21 and the capacitor C21. In the antenna apparatus 103A, this LC parallel resonant circuit corresponds to a "second parallel resonant circuit".

In the antenna apparatus 103A, a loop portion including the radiating element (the inductor L1), the conductor plate (the inductor L2), the first impedance circuit 51, and the second impedance circuit 52 is provided, as illustrated in FIG. 7.

The antenna apparatus 103B according to the third preferred embodiment differs from the antenna apparatus 103A in the configuration of the first impedance circuit 51. The remaining configuration of the antenna apparatus 103B is the same as that of the antenna apparatus 103A. As illustrated in FIG. 6A and FIG. 8, the first impedance circuit 51 in the antenna apparatus 103B has the same configuration as that of the first impedance circuit 51 in the antenna apparatus 102C.

The antenna apparatus 103C according to the third preferred embodiment differs from the antenna apparatus 103B in the configuration of the second impedance circuit 52. The remaining configuration of the antenna apparatus 103C is the same as that of the antenna apparatus 103B.

The second impedance circuit 52 in the antenna apparatus 103C includes the inductor L21, the capacitor C21, and a capacitor C22, as illustrated in FIG. 9. The inductor L21 is connected in series to the capacitor C22. One end of the inductor L21 and one end of the capacitor C21 are connected to the radiating element 1, and the other end of the capacitor C21 and the other end of the capacitor C22 are connected to the conductor plate 2. The second impedance circuit 52 includes an LC parallel resonant circuit including the inductor L21 and the capacitors C21 and C22. In the antenna apparatus 103C, this LC parallel resonant circuit corresponds to the "second parallel resonant circuit".

The antenna apparatus 103D according to the third preferred embodiment differs from the antenna apparatus 103C in the configurations of the first impedance circuit 51 and the second impedance circuit 52. The remaining configuration of the antenna apparatus 103D is the same as that of the antenna apparatus 103C.

The first impedance circuit 51 in the antenna apparatus 103D includes the inductors L11 and L12, the capacitors C11 and C12, and capacitors C13 and C14. The inductor L11 and the capacitors C11 and C12 define an LC parallel circuit, and the inductor L12 and the capacitors C13 and C14 define an LC parallel circuit. The first impedance circuit 51 in the antenna apparatus 103D has a configuration in which the above two LC parallel circuits are connected in series to each other. In other words, the first impedance circuit 51 in the antenna apparatus 103D has a configuration in which the LC parallel circuit including the inductor L12 and the capacitors C13 and C14 is connected in series to the first impedance circuit 51 in the antenna apparatus 103C.

The second impedance circuit 52 in the antenna apparatus 103D includes the inductor L21, an inductor L22, the capacitors C21 and C22, and capacitors C23 and C24. The inductor L21 and the capacitors C21 and C22 define an LC parallel circuit, and the inductor L22 and the capacitors C23 and C24 define an LC parallel circuit. The second impedance circuit 52 has a configuration in which the above two LC parallel circuits are connected in series to each other. In other words, the second impedance circuit 52 has a configuration in which the LC parallel circuit including the inductor L22 and the capacitors C23 and C24 is connected in series to the second impedance circuit 52 in the antenna apparatus 103C.

Also in the above configuration, the basic configurations of the antenna apparatuses 103A, 103B, 103C, and 103D are the same as the configuration of the antenna apparatus 101 according to the first preferred embodiment and the same effects and advantages as those of the antenna apparatus 101 are achieved.

Setting the resonant frequency of the first parallel resonant circuit and the resonant frequency of the second parallel resonant circuit to the first frequency band (for example, the UHF band or the SHF band) produces very high impedance at the set frequencies. Accordingly, the radiating element 1 is capable of being reliably separated from the loop portion in the first frequency band (the UHF band or the SHF band), compared with the case in which the inductor L1 and the capacitor C1 are connected. Accordingly, it is easy to design (for example, the width and the length of the radiating element) the radiating element 1 that resonates in the first frequency band (the UHF band or the SHF band) to define and function as the standing-wave antenna contributing to electric-field radiation.

The second parallel resonant circuit in the second impedance circuit 52 is not limited to the LC parallel resonant circuit including only the inductor L21 and the capacitor C21, as illustrated in the antenna apparatus 103C. The number or other features and characteristics of the reactance elements used in the configuration of the second parallel resonant circuit may be appropriately varied as long as the LC parallel resonant circuit is capable of being provided.

The second impedance circuit 52 may have a configuration in which multiple LC parallel circuits are connected in series to each other as long as at least one of the LC parallel circuits defines an LC parallel resonant circuit (the second parallel resonant circuit), as illustrated in the antenna apparatus 103D.

When all of the multiple LC parallel circuits connected in series to each other define LC parallel resonant circuits in the second impedance circuit 52, a configuration may be adopted in which the resonant frequency is set for each LC parallel resonant circuit. As described above, with this configuration, the radiating element defines and functions as the standing-wave antenna to support multiple systems of different frequency bands including the UHF band and the SHF band.

Fourth Preferred Embodiment

Figure 11A:
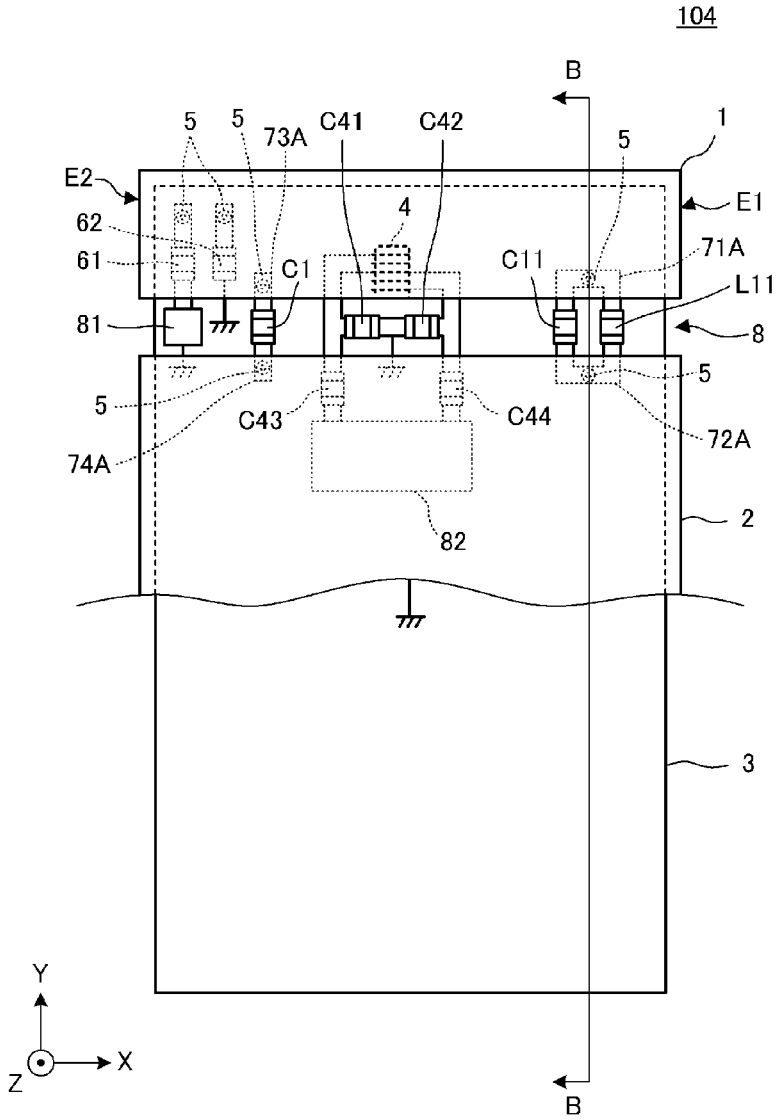
FIG. 11A is a plan view of an antenna apparatus 104 according to a fourth preferred embodiment of the present invention and FIG. 11B is a cross-sectional view in FIG. 11A, taken along a B-B line.
Figure 11B:
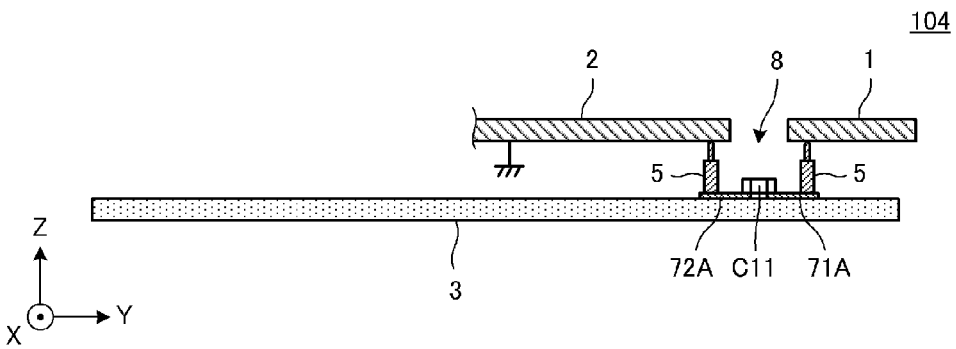
Figure 12:
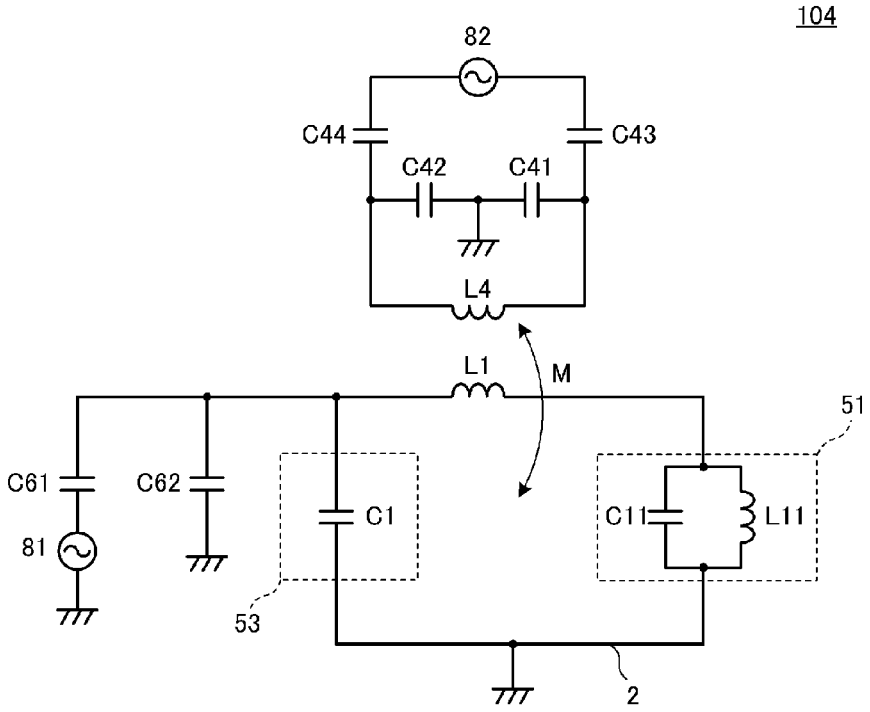
FIG. 12 is an equivalent circuit diagram of lumped elements in the antenna apparatus 104.

FIG. 11A is a plan view of an antenna apparatus 104 according to a fourth preferred embodiment of the present invention. FIG. 11B is a cross-sectional view in FIG. 11A, taken along a B-B line. FIG. 12 is an equivalent circuit diagram of lumped elements in the antenna apparatus 104.

The antenna apparatus 104 according to the fourth preferred embodiment differs from the antenna apparatus 101 in that the conductor plate 2 is grounded. The remaining configuration of the antenna apparatus 104 is the same as that of the antenna apparatus 101 according to the first preferred embodiment.

Since the conductor plate 2 in the antenna apparatus 104 is grounded, it may be said that the radiating element 1 is grounded via the capacitor C1, as illustrated in FIG. 12. The capacitor C1 corresponds to a "reactance circuit" 53 in the present preferred embodiment.

Also in the above configuration, the basic configuration of the antenna apparatus 104 is the same as that of the antenna apparatus 101 according to the first preferred embodiment and the same effects and advantages as those of the antenna apparatus 101 are achieved.

Although a method of connecting the substrate 3 to the ground using, for example, a movable probe pin is considered as a grounding method, the grounding method is not limited to this and may be appropriately varied. In addition, the positions, the numbers, and so on of ground points may be appropriately varied.

Fifth Preferred Embodiment

Figure 13:
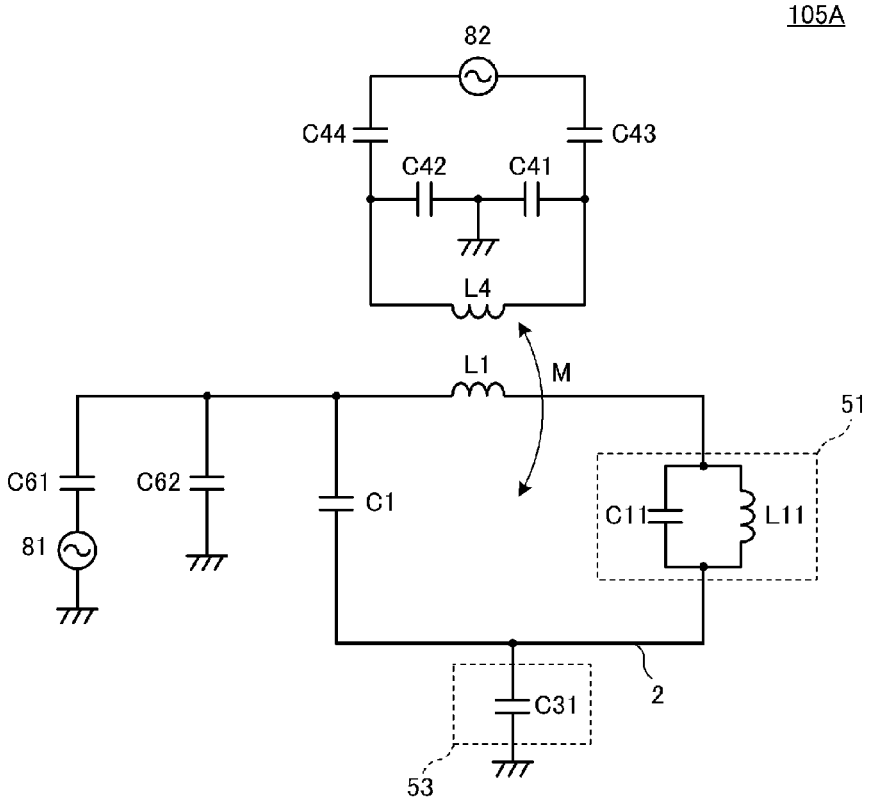
FIG. 13 is an equivalent circuit diagram of lumped elements in an antenna apparatus 105A according to a fifth preferred embodiment of the present invention.
Figure 14:
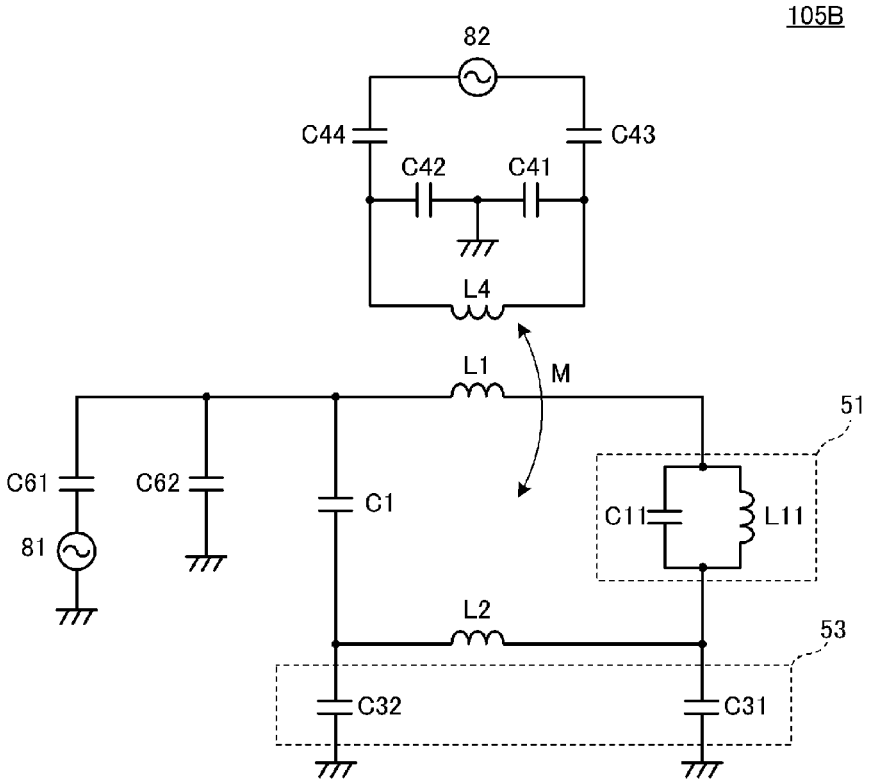
FIG. 14 is an equivalent circuit diagram of lumped elements in an antenna apparatus 105B.
Figure 15:
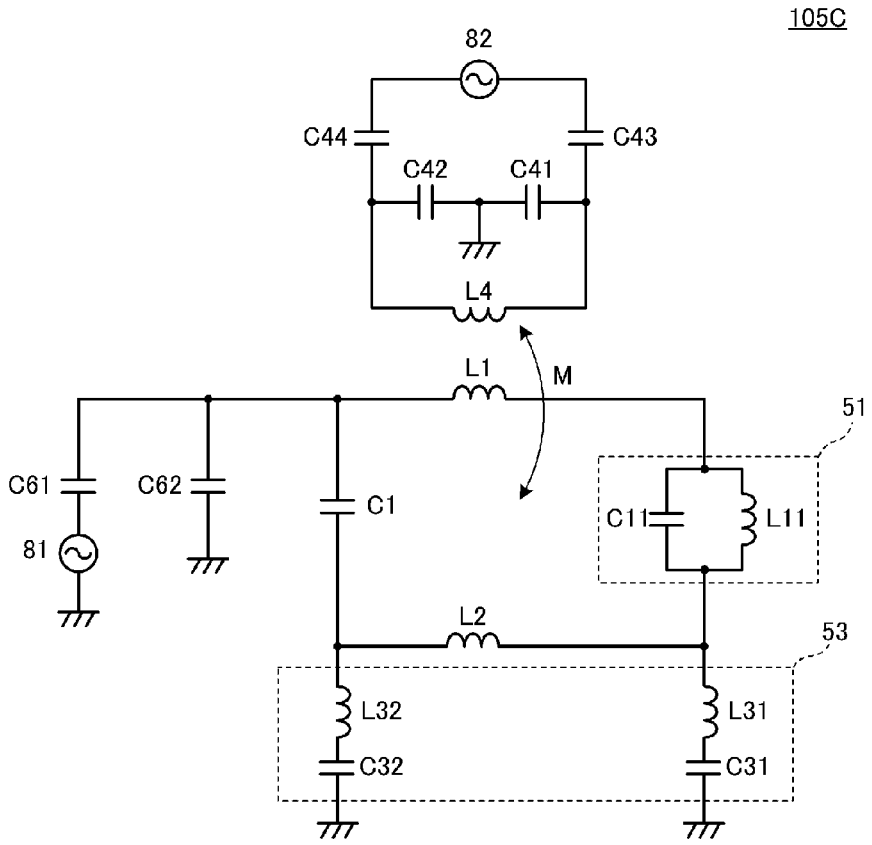
FIG. 15 is an equivalent circuit diagram of lumped elements in an antenna apparatus 105C.

FIG. 13 is an equivalent circuit diagram of lumped elements in an antenna apparatus 105A according to a fifth preferred embodiment of the present invention. FIG. 14 is an equivalent circuit diagram of lumped elements in an antenna apparatus 105B. FIG. 15 is an equivalent circuit diagram of lumped elements in an antenna apparatus 105C.

The antenna apparatus 105A according to the fifth preferred embodiment differs from the antenna apparatus 104 in that the antenna apparatus 105A further includes a capacitor C31.

The remaining configuration of the antenna apparatus 105A is the same as that of the antenna apparatus 104 according to the fourth preferred embodiment.

As illustrated in FIG. 13, the capacitor C31 is connected between the conductor plate 2 and the ground. In other words, the conductor plate 2 in the antenna apparatus 105A is grounded via the capacitor C31. In the antenna apparatus 105A, the capacitor C31 corresponds to the "reactance circuit" 53. The capacitor C31 has low impedance in the UHF band or the SHF band (the first frequency band) and is equivalently in the short-circuited state. Accordingly, the conductor plate 2 is grounded at a certain position.

The antenna apparatus 105B according to the fifth preferred embodiment differs from the antenna apparatus 104 in that the antenna apparatus 105B further includes the capacitor C31 and a capacitor C32. The remaining configuration of the antenna apparatus 105B is the same as that of the antenna apparatus 104.

As illustrated in FIG. 14, both of the capacitors C31 and C32 are connected between the conductor plate and the ground. In other words, the conductor plate (the inductor L2) in the antenna apparatus 105B is grounded via the capacitors C31 and C32. In the antenna apparatus 105B, the capacitors C31 and C32 correspond to the "reactance circuit" 53. The capacitors C31 and C32 have low impedance in the UHF band or the SHF band (the first frequency band) and are equivalently in the short-circuited state. Accordingly, the conductor plate is grounded at two certain positions.

The antenna apparatus 105C according to the fifth preferred embodiment differs from the antenna apparatus 104 in that the antenna apparatus 105C further includes the capacitors C31 and C32 and inductors L31 and L32. The remaining configuration of the antenna apparatus 105C is the same as that of the antenna apparatus 104.

As illustrated in FIG. 15, the inductor L31 and the capacitor C31 are connected in series to each other and are connected between the conductor plate 2 and the ground. The inductor L32 and the capacitor C32 are connected in series to each other and are connected between the conductor plate and the ground. In other words, the conductor plate (the inductor L2) in the antenna apparatus 105C is grounded via the series circuit including the inductor L31 and the capacitor C31 and the series circuit including the inductor L32 and the capacitor C32. In the antenna apparatus 105C, these two series circuits correspond to the "reactance circuit" 53.

Also in the above configuration, the basic configurations of the antenna apparatuses 105A, 105B, and 105C are the same as that of the antenna apparatus 104 according to the fourth preferred embodiment and the same effects and advantages as those of the antenna apparatus 104 are achieved.

As illustrated in the antenna apparatus 105C, the reactance circuit 53 is not limited to the configuration including only the capacitor C31. The reactance elements used in the configuration may be appropriately varied as long as the reactance elements have low impedance in the UHF band or the SHF band (the first frequency band) and are equivalently in the short-circuited state.

Although each of the inductors L31 and L32 is, for example, an inductor component such as a chip inductor and each of the capacitors C31 and C32 is, for example, a capacitor component such as a chip capacitor, this configuration is not limiting on preferred embodiments of the present invention. The configurations of the inductors and the capacitors may be appropriately varied as long as the inductors and the capacitors have low impedance in the UHF band or the SHF band (the first frequency band) and are equivalently in the short-circuited state. For example, capacitance generated by the ground may be used as the capacitors and the inductors and the capacitors may be including stubs or the likes.

As in the antenna apparatus 104 according to the fourth preferred embodiment, the positions, the numbers, and so on of the ground points may be appropriately varied.

Sixth Preferred Embodiment

Figure 16A:
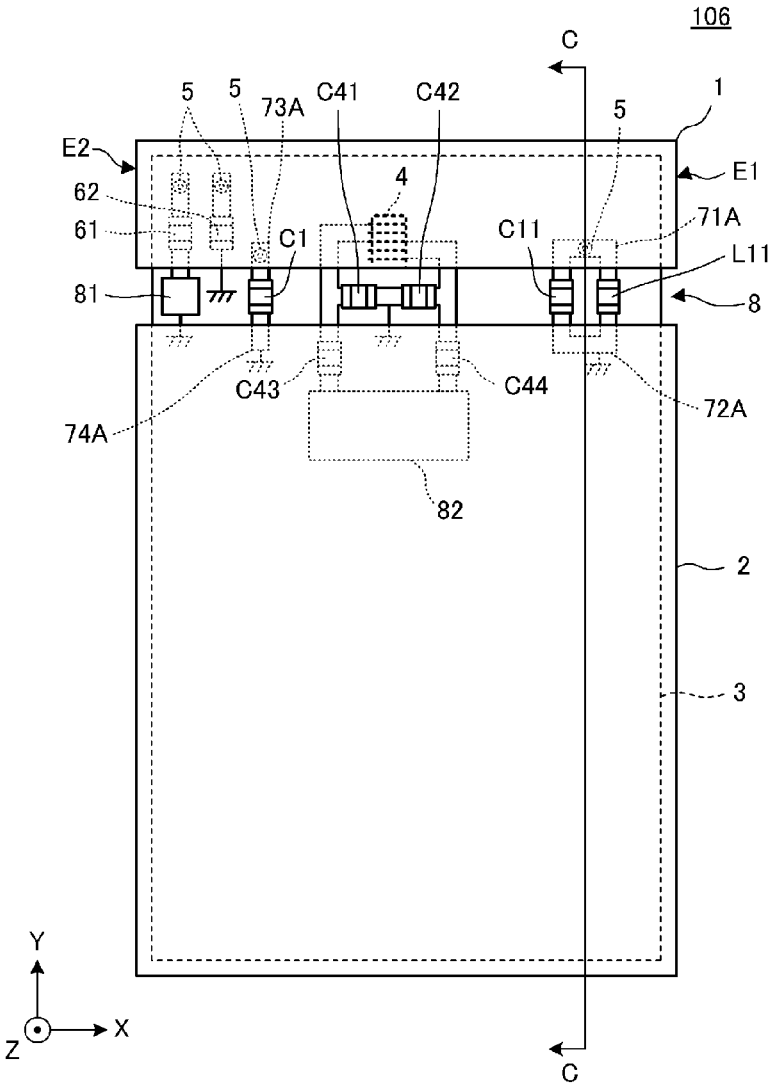
FIG. 16A is a plan view of an antenna apparatus 106 according to a sixth preferred embodiment of the present invention and FIG. 16B is a cross-sectional view in FIG. 16A, taken along a C-C line.
Figure 16B:
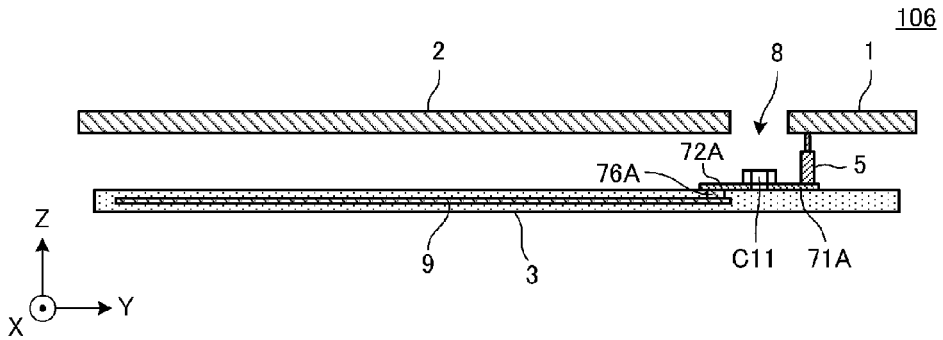
Figure 17:
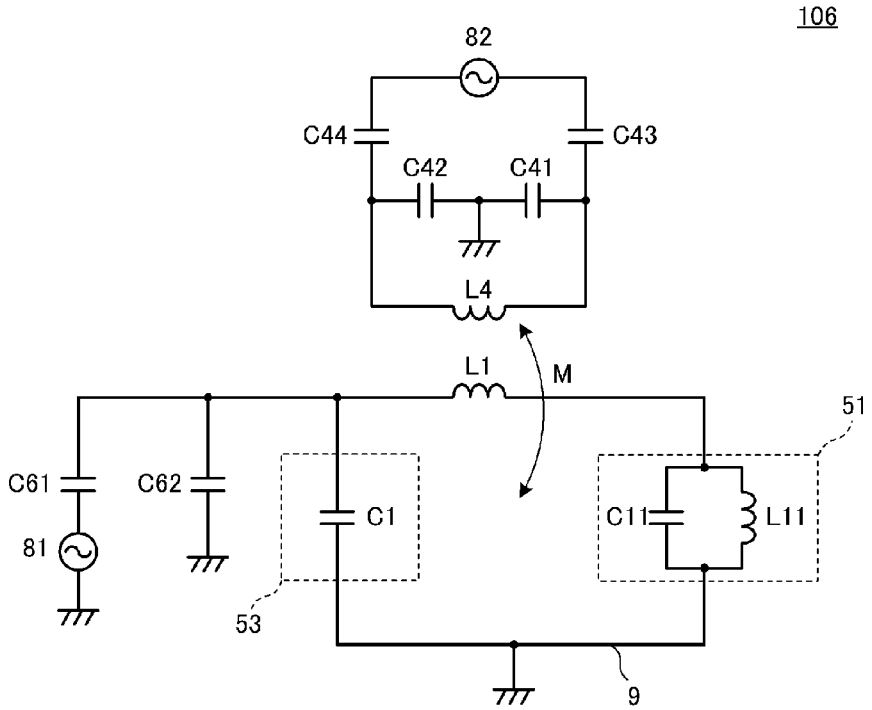
FIG. 17 is an equivalent circuit diagram of lumped elements in the antenna apparatus 106.

FIG. 16A is a plan view of an antenna apparatus 106 according to a sixth preferred embodiment of the present invention. FIG. 16B is a cross-sectional view in FIG. 16A, taken along a C-C line. FIG. 17 is an equivalent circuit diagram of lumped elements in the antenna apparatus 106.

The antenna apparatus 106 according to the sixth preferred embodiment differs from the antenna apparatus 101 in that the antenna apparatus 106 uses a ground conductor 9 in the substrate 3 as a conductive member. The remaining configuration of the antenna apparatus 106 is the same as that of the antenna apparatus 101 according to the first preferred embodiment.

Points different from the antenna apparatus 101 according to the first preferred embodiment will now be described.

The substrate 3 of the antenna apparatus 106 includes the ground conductor 9. In the present preferred embodiment, the ground conductor 9 corresponds to the "conductive member" and corresponds to the "second conductor" held in the housing.

The connection conductor 71A is connected to one end of the inductor L11 and one end of the capacitor C11 and is connected to the radiating element 1 using the connection pin 5. The connection conductor 72A is connected to the other end of the inductor L11 and the other end of the capacitor C11 and is connected to the ground conductor 9 with an interlayer connection conductor 76A interposed between the connection conductor 72A and the ground conductor 9. In other words, one end of the inductor L11 and one end of the capacitor C11 are connected to the radiating element 1 via the connection conductor 71A and the connection pin 5. The other end of the inductor L11 and the other end of the capacitor C11 are connected to the ground conductor 9 via the connection conductor 72A and the interlayer connection conductor 76A. The interlayer connection conductor 76A is, for example, a via conductor.

In the antenna apparatus 106, a loop portion including the radiating element 1, the ground conductor 9, the first impedance circuit 51, and the capacitor C1 is provided, as illustrated in FIG. 17.

Also in the above configuration, the basic configuration of the antenna apparatus 106 is the same as that of the antenna apparatus 101 according to the first preferred embodiment and the same effects and advantages as those of the antenna apparatus 101 are achieved.

In addition, since the ground conductor 9 (the second conductor) in the substrate 3 or the like, which is held in the housing of a communication terminal apparatus, is capable of being used as a portion of the antenna in the antenna apparatus 106, the conductive member is easily configured. Accordingly, it is not necessary to separately form or provide the conductive member and the antenna apparatus 106 is easily manufactured at low cost.

Figure 18A:
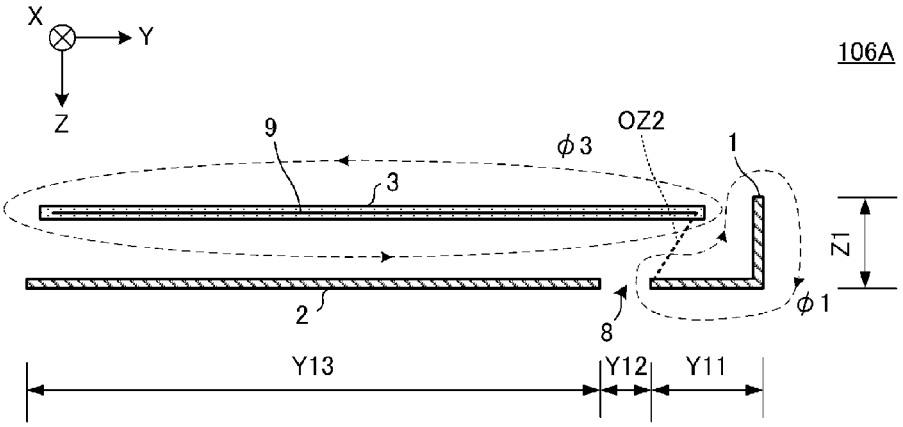
FIG. 18A is a cross-sectional view of an antenna apparatus 106A and FIG. 18B is a cross-sectional view of the antenna apparatus 106A, which indicates the density of magnetic flux generated from the radiating element 1 and a ground conductor 9 in the HF band.
Figure 18B:
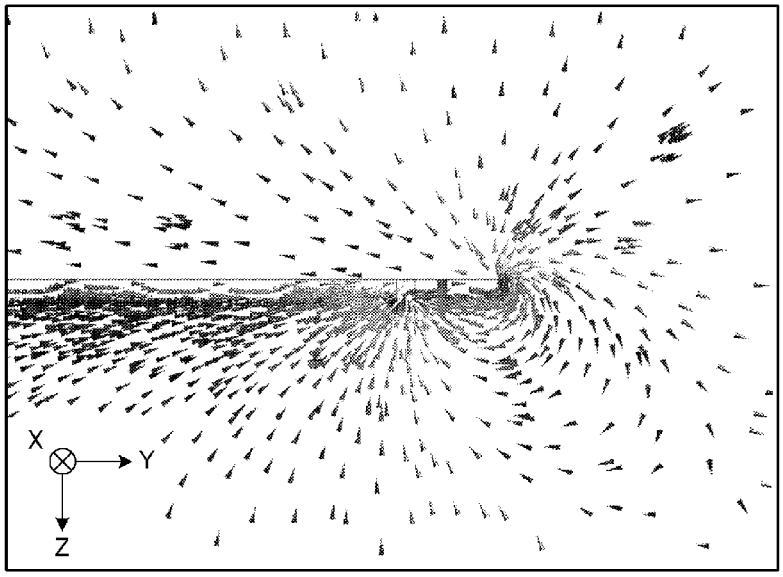

Magnetic fields generated from the radiating element 1 and the ground conductor 9 in the HF band (the second frequency band) will now be described with reference to the drawings. FIG. 18A is a cross-sectional view of an antenna apparatus 106A. FIG. 18B is a cross-sectional view of the antenna apparatus 106A, which indicates the density of magnetic flux generated from the radiating element 1 and the ground conductor 9 in the HF band.

The antenna apparatus 106A differs from the antenna apparatus 106 in that the radiating element 1 is not a flat plate and preferably has an L-shaped or substantially L-shaped cross-sectional shape. The remaining configuration of the antenna apparatus 106A is substantially the same as that of the antenna apparatus 106. The dimensions of portions are the same as those in the antenna apparatus 101A illustrated in FIG. 4A.

As illustrated in FIGS. 18A and 18B, in the antenna apparatus 106A in which the loop portion including the ground conductor 9, instead of the conductor plate, is composed, the directivity of the antenna may be varied, compared with the antenna apparatus 101A illustrated in FIG. 4B.

Both the magnetic flux $\phi$1 generated around the radiating element 1 and magnetic flux $\phi$3 generated around the ground conductor 9 pass through an opening OZ2 (a gap between an end portion of the radiating element 1 and an end portion of the ground conductor 9). Accordingly, the direction of the magnetic flux $\phi$3 passing between the conductor plate 2 and the ground conductor 9 (the right direction in FIG. 18B) is opposite to that in the antenna apparatus 101A illustrated in FIG. 4B. Since the use of the ground conductor 9 as the conductive member in the above manner enables the directivity of the antenna to be varied, it is possible to appropriately set the directivity of the antenna in consideration of the influence of the electronic components and the likes mounted around the antenna apparatus.

Seventh Preferred Embodiment

Figure 19A:
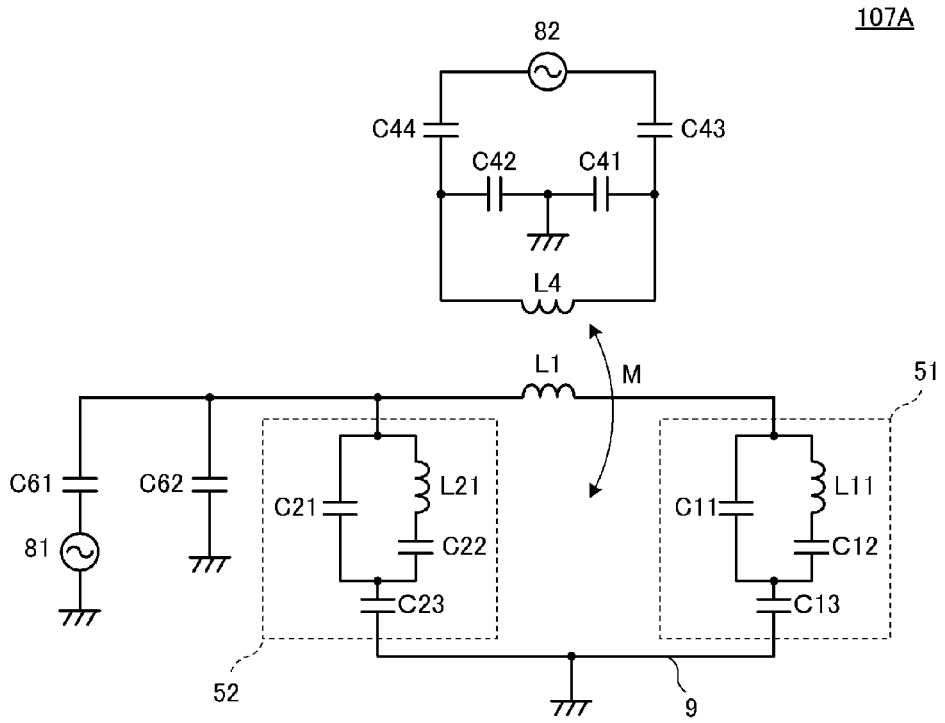
FIG. 19A is an equivalent circuit diagram of lumped elements in an antenna apparatus 107A according to a seventh preferred embodiment of the present invention and FIG. 19B is an equivalent circuit diagram of lumped elements in an antenna apparatus 107B.
Figure 19B:
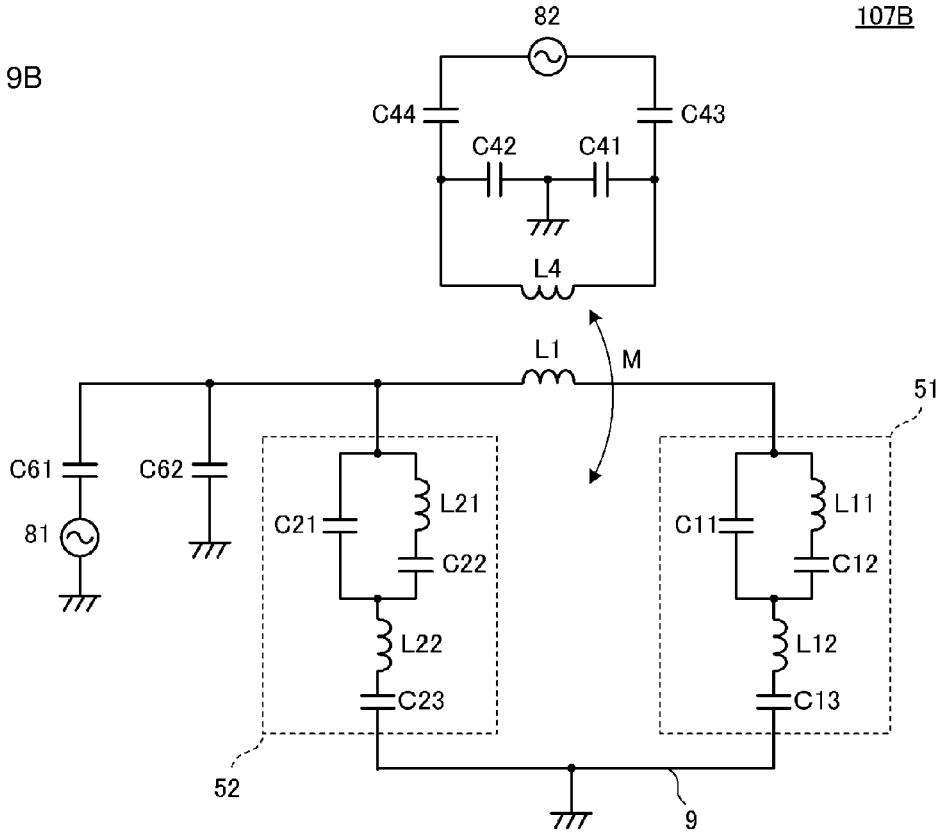

FIG. 19A is an equivalent circuit diagram of lumped elements in an antenna apparatus 107A according to a seventh preferred embodiment. FIG. 19B is an equivalent circuit diagram of lumped elements in an antenna apparatus 107B.

The antenna apparatus 107A according to the seventh preferred embodiment differs from differs from the antenna apparatus 106 in the configurations of the first impedance circuit and the second impedance circuit 52. The remaining configuration of the antenna apparatus 107A is the same as that of the antenna apparatus 106.

The first impedance circuit 51 in the antenna apparatus 107A includes the inductor L11 and the capacitors C11, C12, and C13. The inductor L11 and the capacitors C11 and C12 form an LC parallel circuit. The first impedance circuit 51 has a configuration in which the LC parallel circuit and the capacitor C13 are connected in series to each other.

The second impedance circuit 52 in the antenna apparatus 107A includes the inductor L21 and the capacitors C21, C22, and C23. The inductor L21 and the capacitors C21 and C22 define an LC parallel circuit. The second impedance circuit 52 has a configuration in which the LC parallel circuit and the capacitor C23 are connected in series to each other.

The antenna apparatus 107B according to the seventh preferred embodiment differs from the antenna apparatus 107A in that the antenna apparatus 107B further includes the inductors L12 and L22. The remaining configuration of the antenna apparatus 107B is the same as that of the antenna apparatus 107A.

The first impedance circuit 51 in the antenna apparatus 107B includes the inductors L11 and L12 and the capacitors C11, C12, and C13. The inductor L11 and the capacitors C11 and C12 define an LC parallel circuit. The first impedance circuit 51 has a configuration in which the inductor L12 and the capacitor C13 are sequentially connected in series to the LC parallel circuit. The second impedance circuit 52 in the antenna apparatus 107B includes the inductors L21 and L22 and the capacitors C21, C22, and C23. The inductor L21 and the capacitors C21 and C22 define an LC parallel circuit. The second impedance circuit 52 has a configuration in which the inductor L22 and the capacitor C23 are sequentially connected in series to the LC parallel circuit.

Also in the above configuration, the basic configurations of the antenna apparatuses 107A and 107B are the same as that of the antenna apparatus 106 according to the sixth preferred embodiment and the same effects and advantages as those of the antenna apparatus 106 are achieved.

As described in the present preferred embodiment, the first impedance circuit 51 and the second impedance circuit 52 do not limitedly have the configuration including one LC parallel circuit or the configuration in which multiple LC parallel circuits are connected in series to each other. The first impedance circuit 51 and the second impedance circuit 52 may each have a configuration in which another reactance element (an inductor or a capacitor) is connected in series to the LC parallel circuit as long as at least one first parallel resonant circuit and at least one second parallel resonant circuit are provided.

Eighth Preferred Embodiment

Figure 20A:
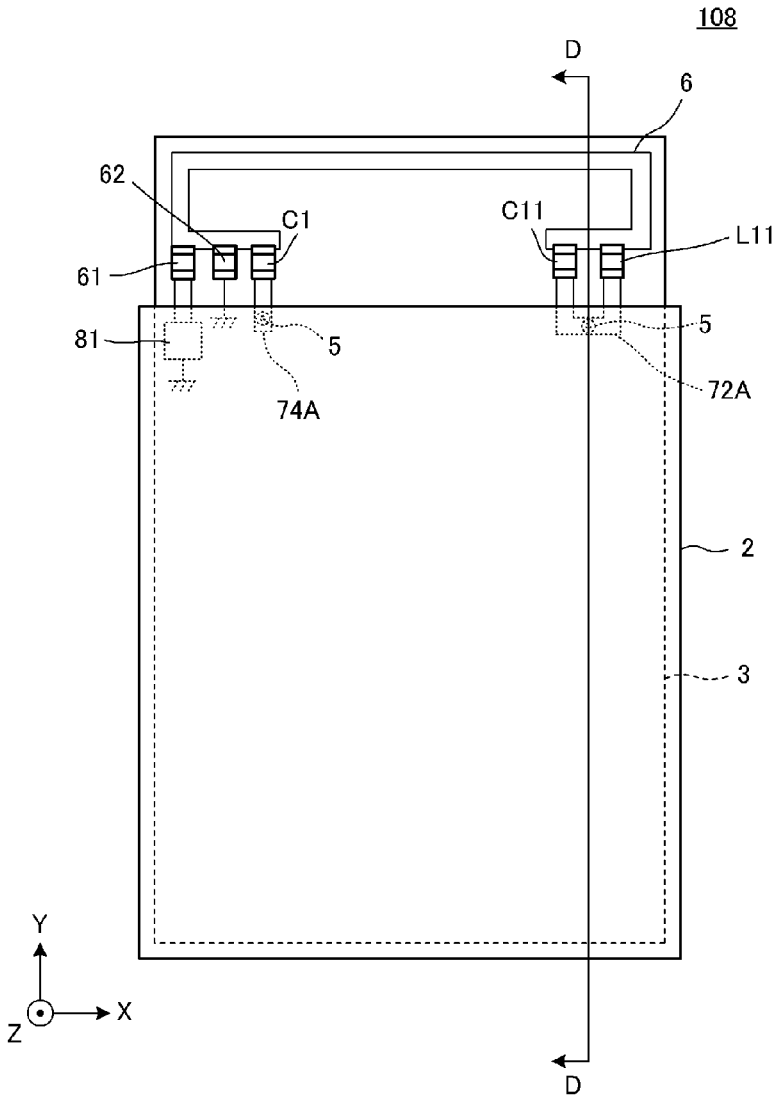
FIG. 20A is a plan view of an antenna apparatus 108 according to an eighth preferred embodiment of the present invention and FIG. 20B is a cross-sectional view in FIG. 20A, taken along a D-D line.
Figure 20B:
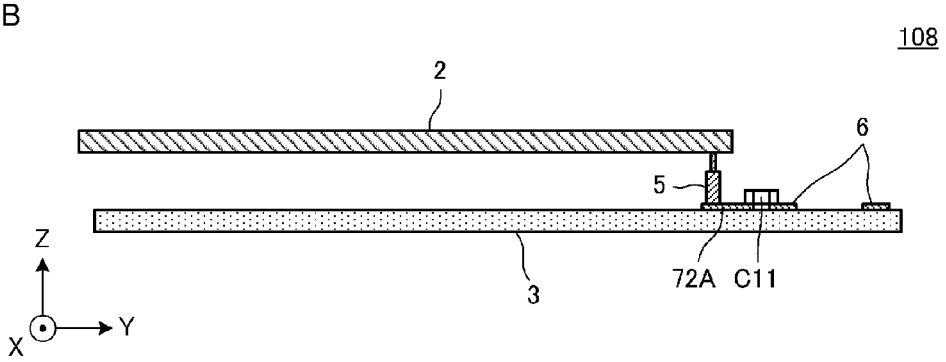

FIG. 20A is a plan view of an antenna apparatus 108 according to an eighth preferred embodiment of the present invention. FIG. 20B is a cross-sectional view in FIG. 20A, taken along a D-D line.

The antenna apparatus 108 according to the eighth preferred embodiment differs from the antenna apparatus 101 according to the first preferred embodiment in that the antenna apparatus 108 uses a radiation conductor 6 located on the substrate 3 as the radiating element. The remaining configuration of the antenna apparatus 108 is substantially the same as that of the antenna apparatus 101.

Points different from the antenna apparatus 101 according to the first preferred embodiment will now be described.

The radiation conductor 6 is a conductive pattern having a C-shaped planar shape and is located on the main surface of the substrate 3. In the present preferred embodiment, the radiation conductor 6 corresponds to the "radiating element" and corresponds to the "first conductor" held in the housing.

The first impedance circuit 51 is directly connected between the radiation conductor 6 and the conductor plate 2. One end of the inductor L11 and one end of the capacitor C11 are directly connected to the radiation conductor. The other end of the inductor L11 and the other end of the capacitor C11 are connected to the conductor plate 2 via the connection conductor 72A and the connection pin 5.

The capacitor C1 is connected between the radiation conductor 6 and the conductor plate 2 via the connection conductor 74A located on the main surface of the substrate 3 and the connection pin 5.

Accordingly, a loop portion including the radiation conductor 6, the conductor plate 2, the first impedance circuit 51, and the capacitor C1 is provided, as illustrated in FIG. 20A.

Also in the above configuration, the basic configuration of the antenna apparatus 108 is the same as that of the antenna apparatus 101 according to the first preferred embodiment and the same effects and advantages as those of the antenna apparatus 101 are achieved. In the antenna apparatus 108 according to the present preferred embodiment, no metal housing preferably exists around the radiation conductor 6 not to prevent generation of the magnetic flux.

Since the radiation conductor 6 has a C-shaped planar shape in the present preferred embodiment, the effective coil opening of the loop portion defining and functioning as the magnetic-field radiation antenna is increased in size in the HF band (the second frequency band). Accordingly, the range and the distance in which the magnetic flux is radiated (collected) is increased, thus making the coupling with the coil of the communication partner antenna easier. In addition, the width, the length, and so on of the radiation conductor 6 are preferably designed so that the radiation conductor 6 defines and functions as the standing-wave antenna in the UHF band or the SHF band (the first frequency band).

Although the example is described in the present preferred embodiment in which the radiation conductor 6 has a C-shaped planar shape, the radiation conductor 6 is not limited to this configuration. The planar shape of the radiation conductor 6 may be appropriately varied within a range having the above function. Specifically, the radiation conductor 6 may have a rectangular, polygonal, circular, or elliptical planar shape, for example.

In the antenna apparatus 108 according to the present preferred embodiment, the existing conductive pattern located on the main surface of the substrate 3 may be used as a portion of the antenna (the radiation conductor 6). In this case, it is not necessary to separately form or provide the radiating element and the antenna apparatus 108 is easily manufactured at low cost.

The reactance element 62 in the present preferred embodiment is not limited to the chip capacitor. The reactance element 62 may be an open stub or a short stub located on the substrate 3. The reactance element 62 may include multiple open stubs or short stubs.

Ninth Preferred Embodiment

Figure 21:
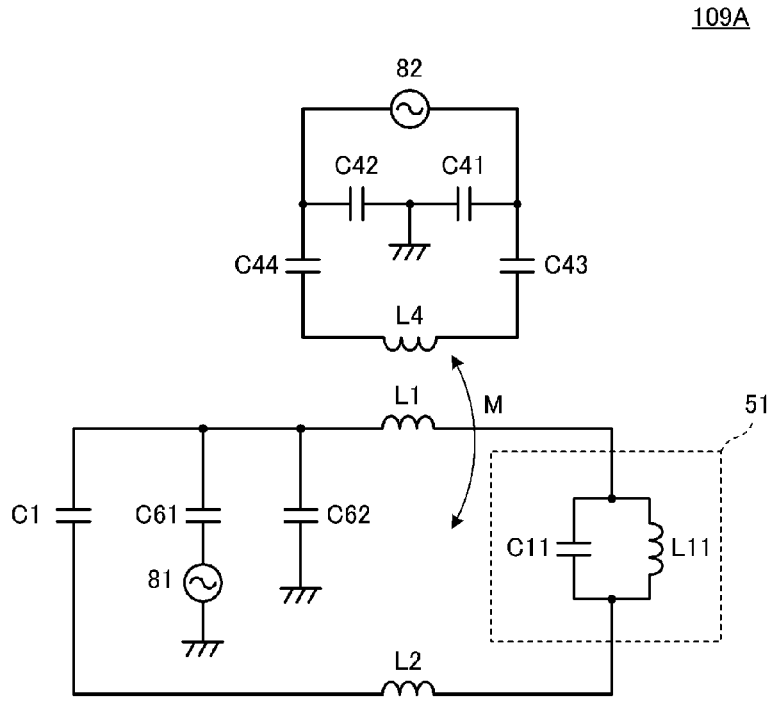
FIG. 21 is an equivalent circuit diagram of lumped elements in an antenna apparatus 109A according to a ninth preferred embodiment of the present invention.
Figure 22:
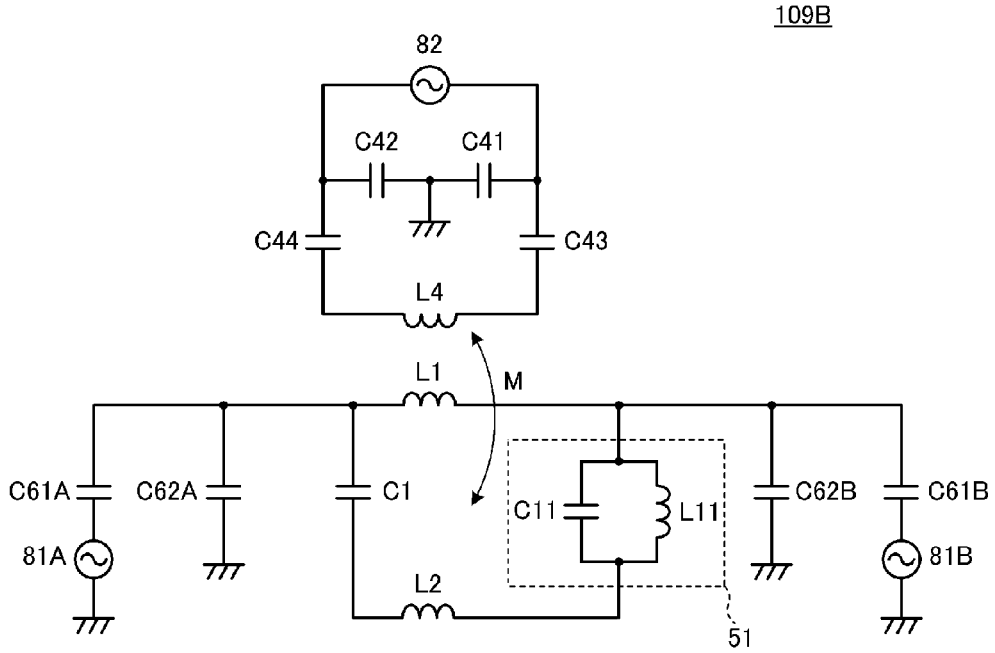
FIG. 22 is an equivalent circuit diagram of lumped elements in an antenna apparatus 109B.

FIG. 21 is an equivalent circuit diagram of lumped elements in an antenna apparatus 109A according to a ninth preferred embodiment of the present invention. FIG. 22 is an equivalent circuit diagram of lumped elements in an antenna apparatus 109B.

The antenna apparatus 109A according to the ninth preferred embodiment differs from the antenna apparatus 101 in the position where the capacitor C1 is mounted. The remaining configuration of the antenna apparatus 109A is the same as that of the antenna apparatus 101.

The first impedance circuit 51 in the antenna apparatus 109A is connected near the first end portion (E1 in FIG. 1) in the long-side direction of the radiating element, and the capacitor C1 is connected near the second end portion (E2 in FIG. 1) in the long-side direction of the radiating element.

Also in the above configuration, the basic configuration of the antenna apparatus 109A is the same as that of the antenna apparatus 101 according to the first preferred embodiment and the same effects and advantages as those of the antenna apparatus 101 are achieved.

In the antenna apparatus 109A, at least the first impedance circuit 51 is connected near the first end portion in the long-side direction of the radiating element. Accordingly, the effective coil opening of the loop portion defining and functioning as the magnetic-field radiation antenna including the radiating element, the conductive member, and the first impedance circuit is increased in size and the range and the distance in which the magnetic flux is radiated (collected) is increased, thus making the coupling with the coil of the communication partner antenna easier. Consequently, it is possible to realize the antenna apparatus having excellent communication characteristics with a simple configuration without using the large-size antenna coil.

Since the capacitor C1 is connected near the second end portion in the long-side direction of the radiating element in the antenna apparatus 109A, the effective coil opening of the loop portion defining and functioning as the magnetic-field radiation antenna is further increased in size, thus realizing the antenna apparatus having more excellent communication characteristics.

Although the example is described in which the capacitor C1 is connected near the second end portion (E2 in FIG. 1) in the long-side direction of the radiating element in the antenna apparatus 109A, the antenna apparatus 109A is not limited to this configuration. When the second impedance circuit is provided, the antenna apparatus 109A may have a configuration in which the second impedance circuit is connected near the second end portion in the long-side direction of the radiating element.

The antenna apparatus 109B according to the ninth preferred embodiment differs from the antenna apparatus 101 in that the antenna apparatus 109B includes multiple first power supply circuits. The remaining configuration of the antenna apparatus 109B is the same as that of the antenna apparatus 101.

Each of first power supply circuits 81A and 81B preferably is an IC for the UHF band or the SHF band (the first frequency band). An input-output portion of the first power supply circuit 81A is connected near the second end portion (E2 in FIG. 1) in the long-side direction of the radiating element 1 via a capacitor C61A. An input-output portion of the first power supply circuit 81B is connected near the first end portion (E1 in FIG. 1) in the long-side direction of the radiating element 1 via a capacitor C61B. The first power supply circuit 81A is a power supply circuit for, for example, a 2.4-GHz wireless LAN communication system, and the first power supply circuit 81B is a power supply circuit for, for example, a 1.5-GHz GPS communication system.

A capacitor C62A is an element that performs matching of the first power supply circuit 81A with another communication system and is connected near the second end portion (E2 in FIG. 1) in the long-side direction of the radiating element 1. A capacitor C62B is an element that performs matching of the first power supply circuit 81B with another communication system and is connected near the first end portion (E1 in FIG. 1) in the long-side direction of the radiating element 1.

With the above configuration, the antenna apparatus capable of being shared among multiple different systems in the UHF band or the SHF band (the first frequency band) is realized. In this case, each of the first impedance circuit 51 and the second impedance circuit 52 may preferably have the configuration in which multiple LC parallel circuits are connected in series to each other, as illustrated in the antenna apparatus 102D. It is possible to realize the antenna apparatus capable of supporting multiple systems of different frequency bands by using multiple LC parallel circuits that are connected in series to each other and that define LC parallel resonant circuits and defining the resonant frequency for each LC parallel resonant circuit.

Although the example is described in which the two first power supply circuits are provided in the antenna apparatus 109B, the antenna apparatus 109B is not limited to this configuration. The positions where the first power supply circuits are connected, the number of the first power supply circuits, and so on may be appropriately varied within a range having the above function.

Tenth Preferred Embodiment

Figure 23A:
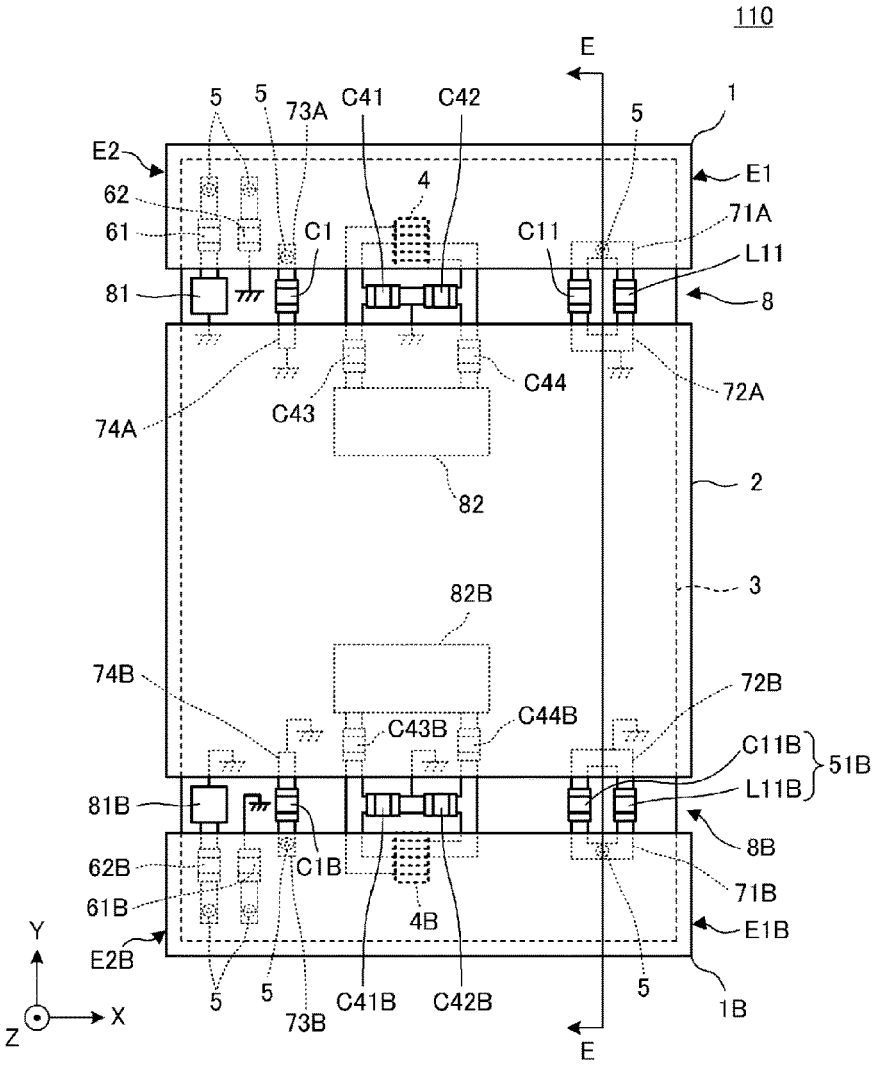
FIG. 23A is a plan view of an antenna apparatus 110 according to a tenth preferred embodiment of the present invention and FIG. 23B is a cross-sectional view in FIG. 20A, taken along an E-E line.
Figure 23B:
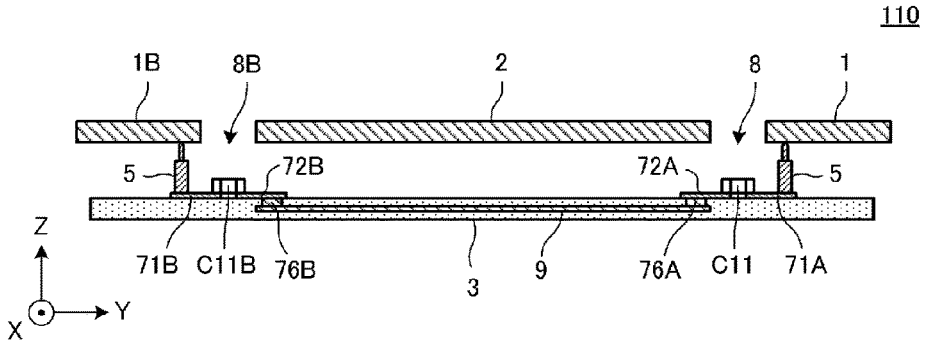

FIG. 23A is a plan view of an antenna apparatus 110 according to a tenth preferred embodiment of the present invention. FIG. 23B is a cross-sectional view in FIG. 23A, taken along an E-E line.

The antenna apparatus 110 according to the tenth preferred embodiment differs from the antenna apparatus 106 according to the sixth preferred embodiment in that the antenna apparatus 110 further includes a radiating element 1B, a first impedance circuit 51B, a capacitor C1B, the first power supply circuit 81B, a second power supply circuit 82B, reactance elements 61B and 62B, and capacitors C41B, C42B, C43B, C44B. The remaining configuration of the antenna apparatus 110 is substantially the same as that of the antenna apparatus 106 according to the sixth preferred embodiment. In other words, the antenna apparatus 110 has a configuration in which the two antenna apparatuses 106 are symmetrically provided in the long-side direction (the Y direction in FIG. 23A) of the substrate 3.

Only points different from the antenna apparatus 106 according to the sixth preferred embodiment will now be described.

The first impedance circuit 51B, the capacitor C1B, the first power supply circuit 81B, the second power supply circuit 82B, the reactance elements 61B and 62B, and the capacitors C41B to C44B are mounted on the substrate 3.

The radiating element 1B is a conductive flat plate preferably having a rectangular or substantially rectangular planar shape, for example. The conductor plate 2 according to the present preferred embodiment is shorter than the conductor plate of the antenna apparatus 106 in the length in the longitudinal direction (the Y direction in FIG. 23A). The radiating element 1B and the conductor plate 2 are arranged in the longitudinal direction with a gap 8B disposed therebetween. The long-side direction of the radiating element 1B coincides with the lateral direction (the X direction in FIG. 23A). The radiating element 1B has a first end portion E1B and a second end portion E2B on both sides in the long-side direction.

The first impedance circuit 51B includes the first parallel resonant circuit (the LC parallel resonant circuit) and is directly connected between the radiating element 1B and the conductor plate 2. The first impedance circuit 51B includes an inductor L11B and a capacitor C11B and is connected near the first end portion E1B in the long-side direction of the radiating element 1B. One end of the inductor L11B and one end of the capacitor C11B are connected to the radiating element 1B via a connection conductor 71B and a connection pin 5. The other end of the inductor L11B and the other end of the capacitor C11B are connected to the ground conductor 9 via a connection conductor 72B and an interlayer connection conductor 76B.

The first impedance circuit 51B includes the LC parallel resonant circuit including the inductor L11B and the capacitor C11B.

The capacitor C1B is connected between the radiating element 1B and the ground conductor 9 via connection conductors 73B and 74B located on the main surface of the substrate 3 and an interlayer connection conductor 75B.

Accordingly, as illustrated in FIG. 23A, a loop portion including the radiating element 1B, the ground conductor 9, the first impedance circuit 51B, and the capacitor C1B is provided.

The first power supply circuit 81B is an IC for the UHF band or the SHF band (the first frequency band). An input-output portion of the first power supply circuit 81B is connected near the second end portion E2B in the long-side direction of the radiating element 1B via a connection conductor located on the main surface of the substrate 3, a connection pin 5, and the reactance element 61B. The reactance element 61B is, for example, an electronic component, such as a chip capacitor. The first power supply circuit 81B is a power supply circuit for, for example, a 1.5-GHz GPS communication system.

The reactance element 62B is an element that performs matching of the first power supply circuit 81B with another communication system and is connected near the second end portion E2B in the long-side direction of the radiating element 1B via a connection conductor located on the main surface of the substrate and a connection pin 5. The reactance element 62B is, for example, an electronic component, such as a chip capacitor.

The second power supply circuit 82B is a balanced input-output IC for the HF band (the second frequency band). A power supply coil 4B is connected to an input-output portion of the second power supply circuit 82B with the capacitors C41B to C44B interposed therebetween. The power supply coil 4 is arranged, in a plan view, at a position that is near the center in the long-side direction (the X direction in FIG. 23A) of the radiating element 1B so that the coil opening of the power supply coil 4B is along an edge portion of the radiating element 1B, which faces the gap 8B. In other words, the coil opening of the power supply coil 4B is arranged so as to face the conductor plate 2. The second power supply circuit 82B is, for example, an RFIC element for 13.56-MHz RFID.

A series circuit including the capacitors C41B and C42B is connected in parallel to the power supply coil 4B to compose an LC resonant circuit. The second power supply circuit 82B supplies a communication signal in the HF band to the LC resonant circuit via the capacitors C43B and C44B. The power supply coil 4B is magnetically coupled to the loop portion including the radiating element 1B, the ground conductor 9, the first impedance circuit 51B, and the capacitor C1B.

With the above configuration, it is possible to realize a communication terminal apparatus including the two antenna apparatuses arranged in the longitudinal direction (the Y direction in FIG. 23A), each of which is capable of being shared among multiple systems of different frequency bands.

Although the example is described in which the radiating element 1, the conductive member (the ground conductor 9), and the radiating element 1B are arranged in the longitudinal direction (in the Y direction), in a plan view, in the antenna apparatus 110 according to the present preferred embodiment, as illustrated in FIG. 23B, the antenna apparatus 110 is not limited to this configuration. The arrangement of the radiating element 1, the conductive member (the ground conductor 9), and the radiating element 1B may be appropriately varied.

Although the example is described in which the two radiating elements 1 and 1B are provided in the antenna apparatus 110 according to the present preferred embodiment, the antenna apparatus 110 is not limited to this configuration. The number and so on of the radiating elements may be appropriately varied.

Eleventh Preferred Embodiment

Figure 24A:
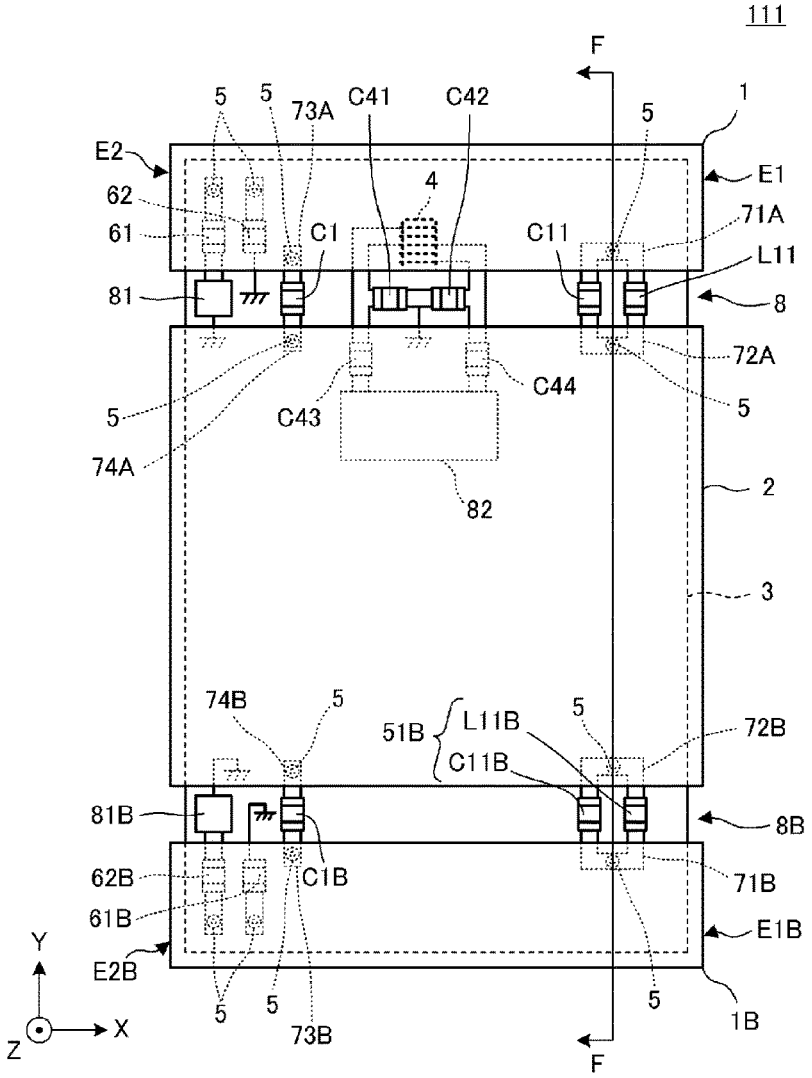
FIG. 24A is a plan view of an antenna apparatus 111 according to an eleventh preferred embodiment of the present invention and FIG. 24B is a cross-sectional view in FIG. 24A, taken along an F-F line.
Figure 24B:
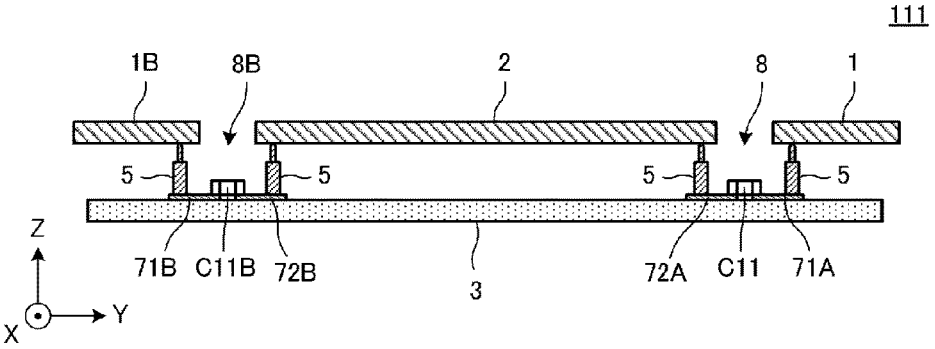

FIG. 24A is a plan view of an antenna apparatus 111 according to an eleventh preferred embodiment of the present invention. FIG. 24B is a cross-sectional view in FIG. 24A, taken along an F-F line.

The antenna apparatus 111 according to the eleventh preferred embodiment differs from the antenna apparatus 101 according to the first preferred embodiment in that the antenna apparatus 111 further includes the radiating element 1B, the first impedance circuit 51B, the capacitor C1B, the first power supply circuit 81B, and the reactance elements 61B and 62B. The remaining configuration of the antenna apparatus 111 is substantially the same as that of the antenna apparatus 101 according to the first preferred embodiment.

Only points different from the antenna apparatus 101 according to the first preferred embodiment will now be described.

The first impedance circuit 51B, the capacitor C1B, the first power supply circuit 81B, and the reactance elements 61B and 62B are mounted on the substrate 3.

The radiating element 1B is a conductive flat plate preferably having a rectangular or substantially rectangular planar shape, for example. The conductor plate 2 according to the present preferred embodiment is shorter than the conductor plate of the antenna apparatus 101 in the length in the longitudinal direction (the Y direction in FIG. 24A). The radiating element 1B and the conductor plate 2 are arranged in the longitudinal direction with the gap 8B disposed therebetween. The long-side direction of the radiating element 1B coincides with the lateral direction (the X direction in FIG. 24A). The radiating element 1B has the first end portion E1B and the second end portion E2B on both sides in the long-side direction.

The first impedance circuit 51B includes the first parallel resonant circuit (the LC parallel resonant circuit) and is directly connected between the radiating element 1B and the conductor plate 2. The first impedance circuit 51B includes the inductor L11B and the capacitor C11B and is connected near the first end portion E1B in the long-side direction of the radiating element 1B. One end of the inductor L11B and one end of the capacitor C11B are connected to the radiating element 1B via the connection conductor 71B and the connection pin 5. The other end of the inductor L11B and the other end of the capacitor C11B are connected to the conductor plate 2 via the connection conductor 72B and a connection pin 5.

The first impedance circuit 51B includes the LC parallel resonant circuit including the inductor L11B and the capacitor C11B.

The capacitor C1B is connected between the radiating element 1B and the conductor plate 2 via the connection conductors 73B and 74B located on the main surface of the substrate 3 and connection pins 5.

Accordingly, as illustrated in FIG. 24A, a large loop portion including the first impedance circuit 51, the radiating element 1, the capacitor C1, the conductor plate 2, the capacitor C1B, the radiating element 1B, and the first impedance circuit 51B is provided. The power supply coil 4 is magnetically coupled to the large loop portion including the first impedance circuit 51, the radiating element 1, the capacitor C1, the conductor plate 2, the capacitor C1B, the radiating element 1B, and the first impedance circuit 51B.

With the above configuration, the effective coil opening defining and functioning as the antenna is further increased in size and the range and the distance in which the magnetic flux is radiated (collected) is increased, thus making the coupling with the coil of the communication partner antenna easier. Accordingly, it is possible to realize the antenna apparatus having more excellent communication characteristics without using the large-size antenna coil.

Twelfth Preferred Embodiment

Figures 25A, 25B:
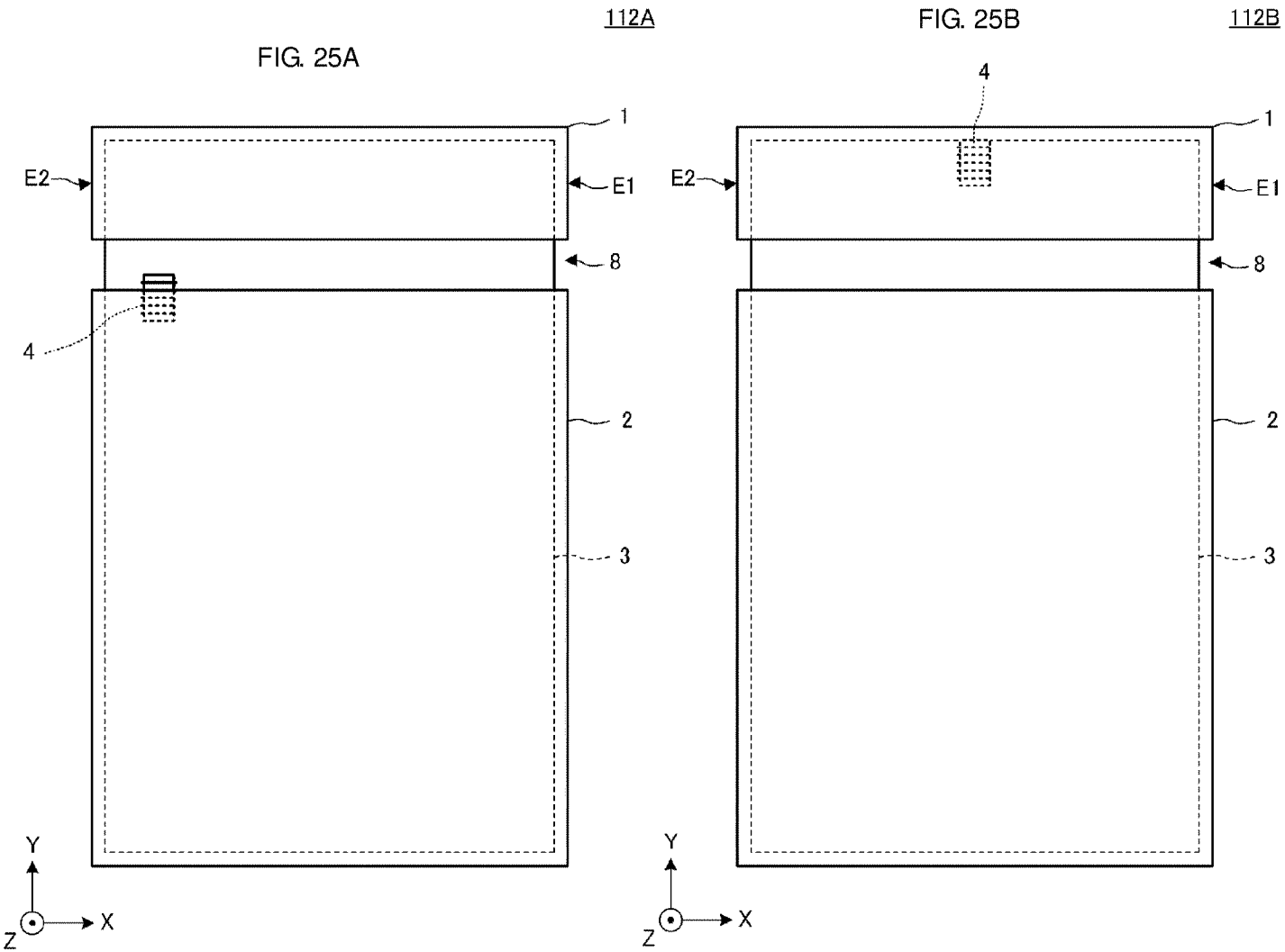
FIG. 25A is a plan view of an antenna apparatus 112A according to a twelfth preferred embodiment of the present invention and FIG. 25B is a plan view of an antenna apparatus 112B.

FIG. 25A is a plan view of an antenna apparatus 112A according to a twelfth preferred embodiment of the present invention. FIG. 25B is a plan view of an antenna apparatus 112B. The first impedance circuit, the second power supply circuit connected to the power supply coil 4, the capacitor, and so on are not illustrated in FIG. 25A and FIG. 25B.

The antenna apparatuses 112A and 112B according to the twelfth preferred embodiment differ from the antenna apparatus 101 according to the first preferred embodiment in the position where the power supply coil 4 is mounted. The remaining configurations of the antenna apparatuses 112A and 112B are substantially the same as that of the antenna apparatus 101 according to the first preferred embodiment.

The power supply coil 4 in the antenna apparatus 112A is arranged at a position near the second end portion E2 in the long-side direction of the radiating element 1 so that a portion of the power supply coil 4 is exposed in the gap 8, in a plan view. The coil opening of the power supply coil 4 is arranged so as to face the radiating element 1 composing part of the loop portion.

The power supply coil 4 in the antenna apparatus 112B is arranged near the center in the long-side direction (the X direction in FIG. 25B) of the radiating element 1 and toward an edge portion in the short-side direction (the Y direction in FIG. 25B) of the radiating element 1, in a plan view. The coil opening of the power supply coil 4 is arranged so as to face an edge portion (an upper edge portion in FIG. 25B) opposing the end portion of the radiating element 1 at the gap 8 side in the short-side direction (the Y direction) of the radiating element 1. Accordingly, the coil opening of the power supply coil 4 is not arranged near the edge portion at the gap 8 side (a lower edge portion in FIG. 25B).

Also in the above configuration, the power supply coil 4 is magnetically or electromagnetically coupled (the electric field coupling and the magnetic field coupling) to the loop portion and the loop portion defines and functions as a booster antenna for the power supply coil 4. Accordingly, it is possible to realize the antenna apparatus having excellent communication characteristics with a simple configuration without using the large-size antenna coil.

The positions where the power supply coil 4 is mounted, illustrated in the present preferred embodiment, are only examples and the power supply coil 4 is not limitedly mounted at the above positions. The position where the power supply coil 4 is mounted may be appropriately varied within a range in which the power supply coil 4 is coupled to the loop portion and the loop portion defines and functions as a booster antenna for the power supply coil 4. However, the power supply coil 4 is preferably close to not the conductive member but the radiating element 1, as described in detail below.

Figure 26:
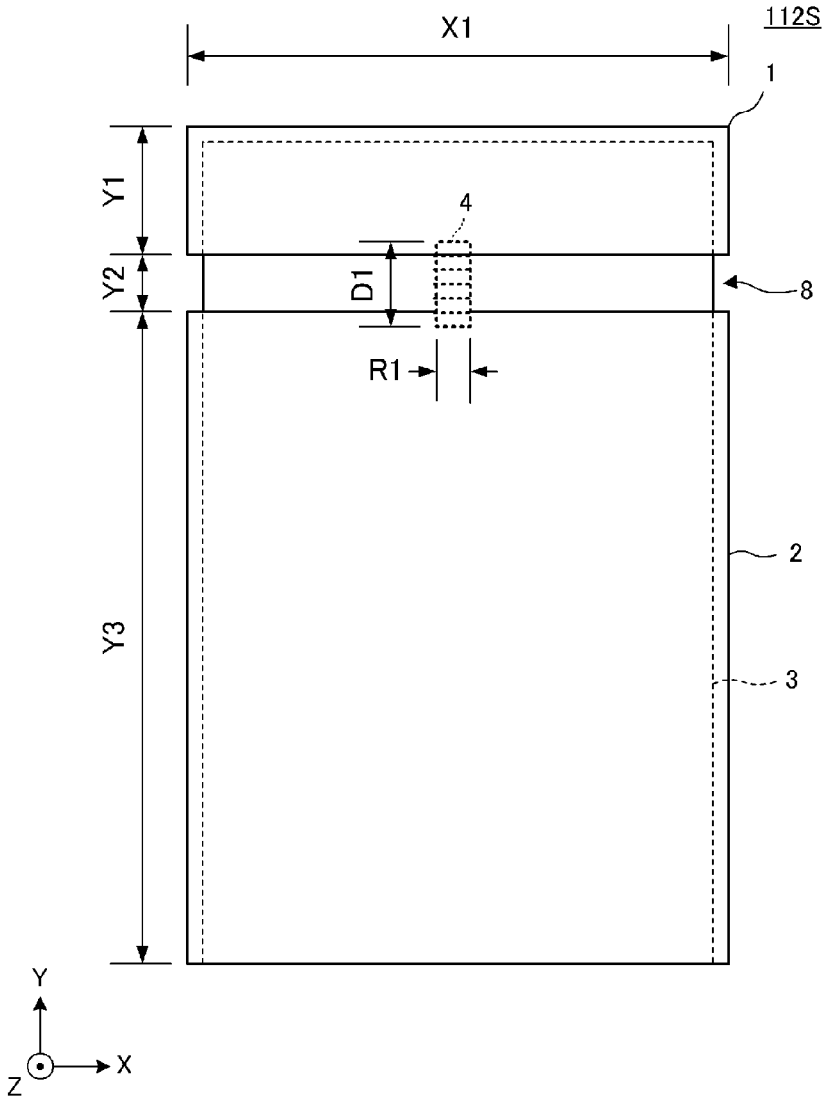
FIG. 26 is a plan view of an antenna apparatus 112S for calculating the degree of coupling between a power supply coil 4 and a booster antenna.

The relationship between the position of the power supply coil 4 and the degree of coupling between the power supply coil 4 and the booster antenna in the HF band (the second frequency band) will now be described with reference to the drawings. FIG. 26 is a plan view of an antenna apparatus 112S for calculating the degree of coupling between the power supply coil 4 and the booster antenna.

Referring to FIG. 26, the dimensions of portions are as follows:

X1 (the length in the X direction of the radiating element 1 and the conductor plate 2): about 60 mm Y1 (the length in the Y direction of the radiating element 1): about 10 mm Y2 (the length in the Y direction of the gap 8): about 2 mm Y3 (the length in the Y direction of a conductive member 20): about 111.5 mm R1 (the diameter of the power supply coil 4): about 2.8 mm D1 (the length in the axial direction of the power supply coil 4): about 5.7 mm In the antenna apparatus 112S, the power supply coil 4 is arranged at a position where the power supply coil 4 is at the center in the long-side direction (the X direction in FIG. 26) of the radiating element 1 and the center in the axial direction of the power supply coil 4 coincides with the center in the Y direction of the gap 8, in a plan view.

Figure 27A:
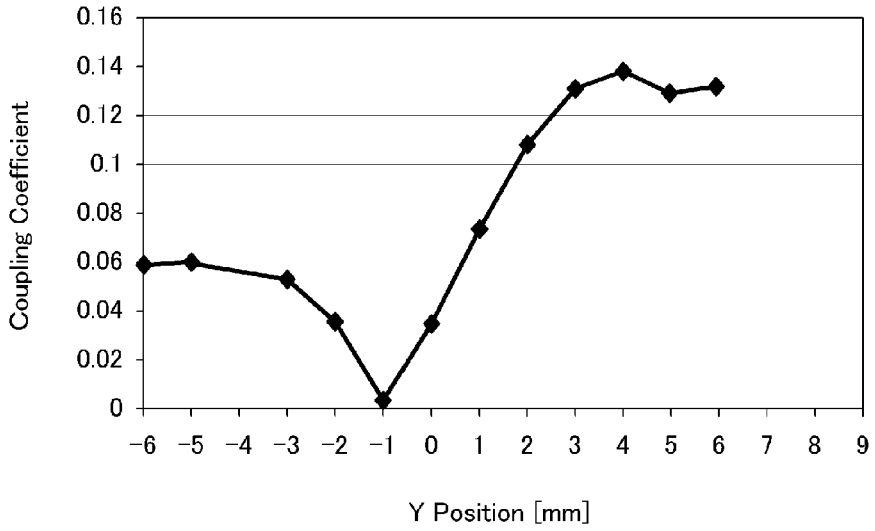
FIG. 27A is a graph illustrating the degree of coupling between the power supply coil 4, and the radiating element 1 and a conductive member 20 (conductor plate) with respect to the position of the power supply coil 4 in the HF band.
Figure 27B:
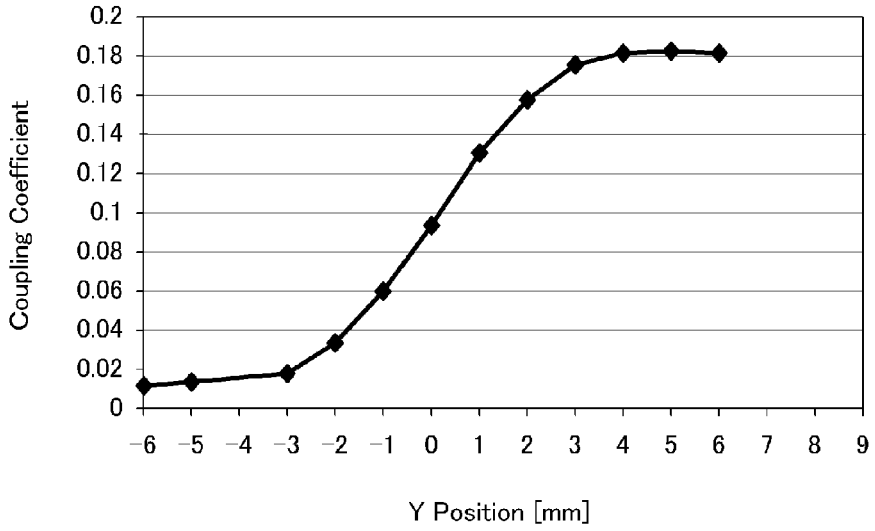
FIG. 27B is a graph illustrating the degree of coupling between the power supply coil 4, and the radiating element 1 and the conductive member 20 (the ground conductor) with respect to the position of the power supply coil 4 in the HF band.

FIG. 27A is a graph illustrating the degree of coupling between the power supply coil 4, and the radiating element 1 and the conductive member 20 (the conductor plate) with respect to the position of the power supply coil 4 in the HF band. FIG. 27B is a graph illustrating the degree of coupling between the power supply coil 4, and the radiating element 1 and the conductive member 20 (the ground conductor) with respect to the position of the power supply coil 4 in the HF band.

FIGS. 27A and 27B illustrate the degree of coupling between the power supply coil 4, and the radiating element 1 and the conductive member 20 when the power supply coil 4 is moved upward and downward in the Y direction in increments of 1 mm with respect to the position in the Y direction of the power supply coil 4 ("Y Position"=0). Referring to FIGS. 27A and 27B, the direction in which the power supply coil 4 is moved upward in FIG. 26 along the Y direction is a positive (+) direction and the direction in which the power supply coil 4 is moved downward in FIG. 26 along the Y direction is a negative (−) direction.

As illustrated in FIG. 27A, the degree of coupling between the loop portion including the radiating element 1 and the conductor plate and the power supply coil 4 is zero when the position of the power supply coil 4 in the Y direction is "Y Position"=−1 mm. This is because, when the coil opening of the loop portion is parallel or substantially parallel to the coil axis of the power supply coil 4, the number of links of the magnetic flux generated from the power supply coil 4 for the loop portion is zero. "Y Position"=−1 mm means a position where the coil opening of the power supply coil 4 is overlapped or substantially overlapped with one end portion of the gap 8 (an upper edge portion in FIG. 26), in a plan view.

FIG. 27A indicates that the degree of coupling is increased as the position of the power supply coil 4 in the Y direction ("Y Position") is moved in the positive direction and the negative direction. As illustrated in FIG. 27A, the degree of coupling between the radiating element 1 and the conductive member 20 (the conductor plate), and the power supply coil 4 is maximized when "Y Position"=about 4 mm, for example. In other words, the degree of coupling is increased when the power supply coil 4 is close to not the conductor plate (the conductive member 20) but the radiating element 1. This is because the width (the length in the Y direction) of the radiating element 1 composing the loop portion is narrower than the width (the length in the Y direction) of the conductor plate 2 defining the loop portion and the inductance of the radiating element 1 is greater than the inductance of the conductor plate 2.

As illustrated in FIG. 27B, the degree of coupling between the loop portion including the radiating element 1 and the ground conductor and the power supply coil 4 is increased as the position of the power supply coil 4 in the Y direction ("Y Position") is moved in the positive direction. In other words, also in the loop portion including the radiating element 1 and the ground conductor, the degree of coupling is increased when the power supply coil 4 is close to not the ground conductor (the conductive member 20) but the radiating element 1 in a plan view.

As illustrated in FIGS. 27A and 27B, the maximum value of the degree of coupling in the loop portion including the radiating element 1 and the ground conductor is higher than that in the loop portion including the radiating element 1 and the conductor plate. This is because the opening of the loop portion including the radiating element 1 and the ground conductor (refer to OZ2 in FIG. 18) has a component in the height direction (the Z direction), compared with the opening of the loop portion including the radiating element 1 and the conductor plate (refer to OZ1 in FIG. 4). In other words, since the opening of the loop portion is not parallel to the coil axis of the power supply coil 4 and has a component in the height direction (the Z direction), the magnetic flux generated from the power supply coil 4 mounted on the main surface of the substrate 3 is easily linked with the loop portion, thus increasing the degree of coupling. When the opening of the loop portion has a component in the height direction, it is difficult to make the number of links of the magnetic flux generated from the power supply coil 4 for the loop portion zero and, thus, the degree of coupling is not set to zero.

As described above, the power supply coil 4 is preferably close to not the conductive member 20 but the radiating element 1.

Thirteenth Preferred Embodiment

Figure 28B:
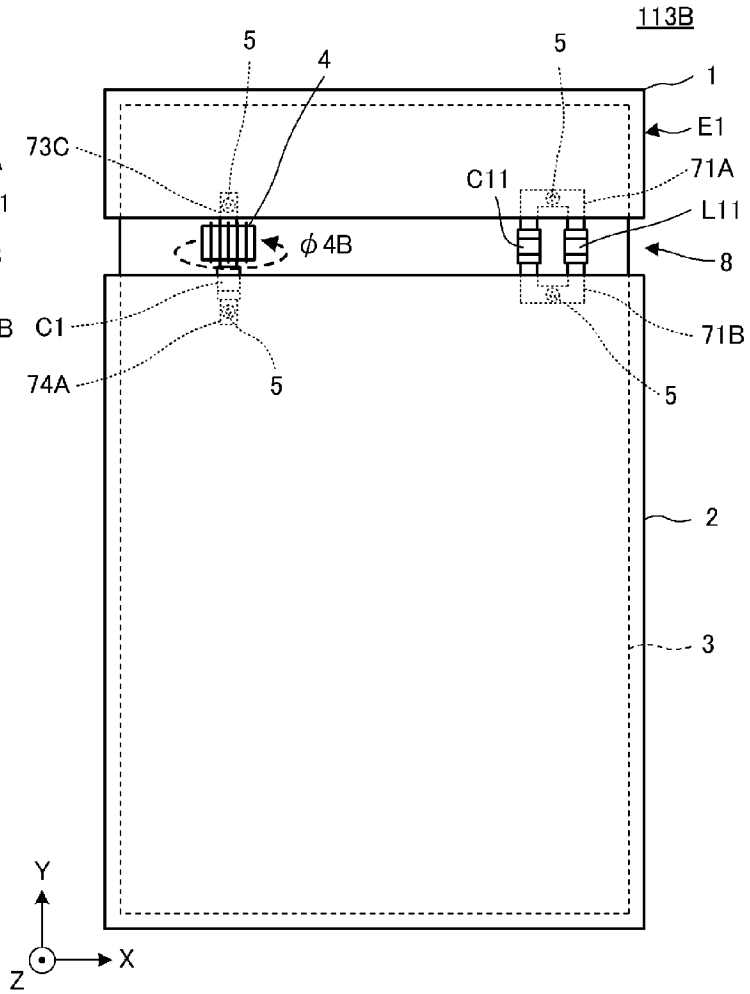
FIG. 28A is a plan view of an antenna apparatus 113A according to a thirteenth preferred embodiment of the present invention and FIG. 28B is a plan view of an antenna apparatus 113B.
Figure 28A:
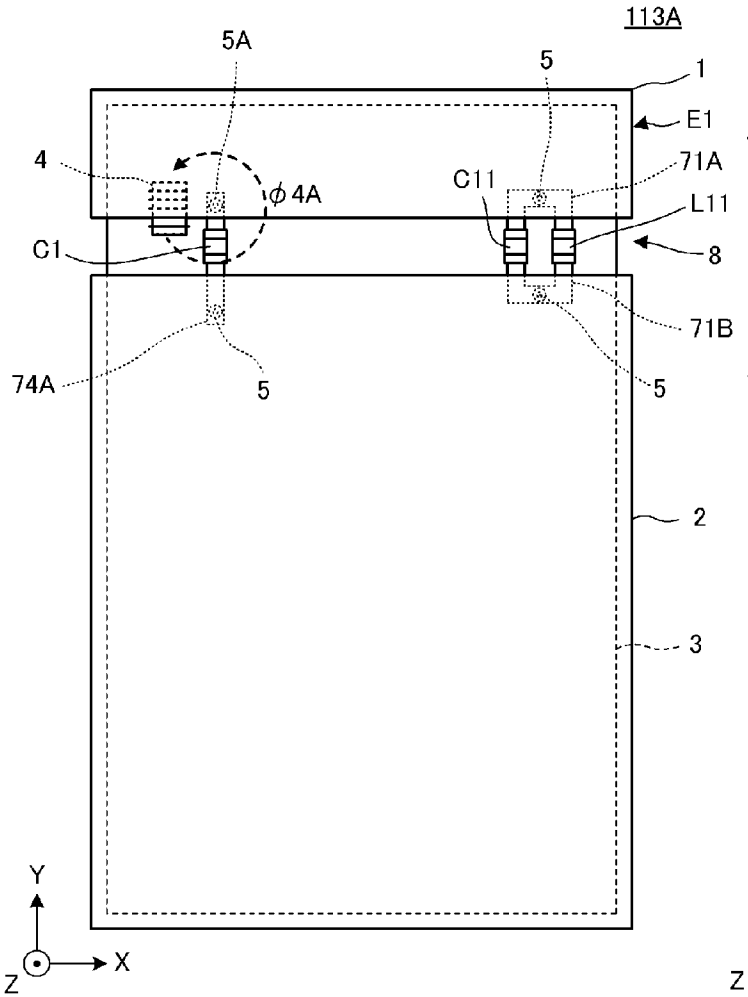

FIG. 28A is a plan view of an antenna apparatus 113A according to a thirteenth preferred embodiment of the present invention. FIG. 28B is a plan view of an antenna apparatus 113B. The second power supply circuit connected to the power supply coil 4, the capacitor, and so on are not illustrated in FIGS. 28A and 28B.

The antenna apparatuses 113A and 113B according to the thirteenth preferred embodiment differ from the antenna apparatus 101 according to the first preferred embodiment in the position where the power supply coil 4 is mounted. The remaining configurations of the antenna apparatuses 113A and 113B are substantially the same as that of the antenna apparatus 101 according to the first preferred embodiment.

The power supply coil 4 in the antenna apparatus 113A is arranged near a connection pin 5A with which the radiating element 1 is connected to the connection conductor 73A, in a plan view. The connection pin 5A is magnetically coupled to the power supply coil 4 with magnetic flux ϕ4 generated from the power supply coil and is electrically coupled to the power supply coil 4 with current flowing through the coil conductor of the power supply coil 4. In other words, the power supply coil 4 in the antenna apparatus 113A is magnetically or electromagnetically coupled (the electric field coupling and the magnetic field coupling) to the connection pin 5A.

The power supply coil 4 in the antenna apparatus 113B is arranged so that the power supply coil 4 is overlapped with a connection conductor 73C and so that the axial direction of the power supply coil 4 is orthogonal to the direction (the Y direction in FIG. 28B in which the connection conductor 73C extends, in a plan view. The connection conductor 73C is magnetically coupled to the power supply coil 4 with magnetic flux ϕ4B generated from the power supply coil 4 and is electrically coupled to the power supply coil 4 with current flowing through the coil conductor of the power supply coil 4. In other words, the power supply coil 4 in the antenna apparatus 113B is magnetically or electromagnetically coupled (the electric field coupling and the magnetic field coupling) to the connection conductor 73C.

Also in the above configuration, the power supply coil is magnetically or electromagnetically coupled (the electric field coupling and the magnetic field coupling) to the loop portion and the loop portion defines and functions as a booster antenna for the power supply coil 4. Accordingly, it is possible to realize the antenna apparatus having excellent communication characteristics with a simple configuration without using the large-size antenna coil.

As described in the present preferred embodiment, the antenna apparatus is not limited to the configuration in which the power supply coil 4 is magnetically or electromagnetically coupled (the electric field coupling and the magnetic field coupling) to the radiating element 1 or the conductive member.

Although the example is described in which the power supply coil 4 is coupled to the connection pin 5A in the antenna apparatus 113A according to the present preferred embodiment, the antenna apparatus 113A is not limited to this configuration. The connection pin coupled to the power supply coil 4 may be appropriately varied.

Although the example is described in which the power supply coil 4 is coupled to the connection conductor 73C in the antenna apparatus 113B according to the present preferred embodiment, the antenna apparatus 113B is not limited to this configuration. The connection conductor coupled to the power supply coil 4 may be appropriately varied.

Although the example is described in the above preferred embodiment in which the power supply coil 4 is coupled to the radiating element 1, the conductive member, the connection pin, or the connection conductor, the power supply coil 4 is not limited to this configuration. A configuration may be adopted in which the power supply coil 4 is magnetically or electromagnetically coupled (the electric field coupling and the magnetic field coupling) to another component as long as the component is part of the loop portion functioning as the booster antenna in the HF band (the second frequency band).

Fourteenth Preferred Embodiment

Figure 29:
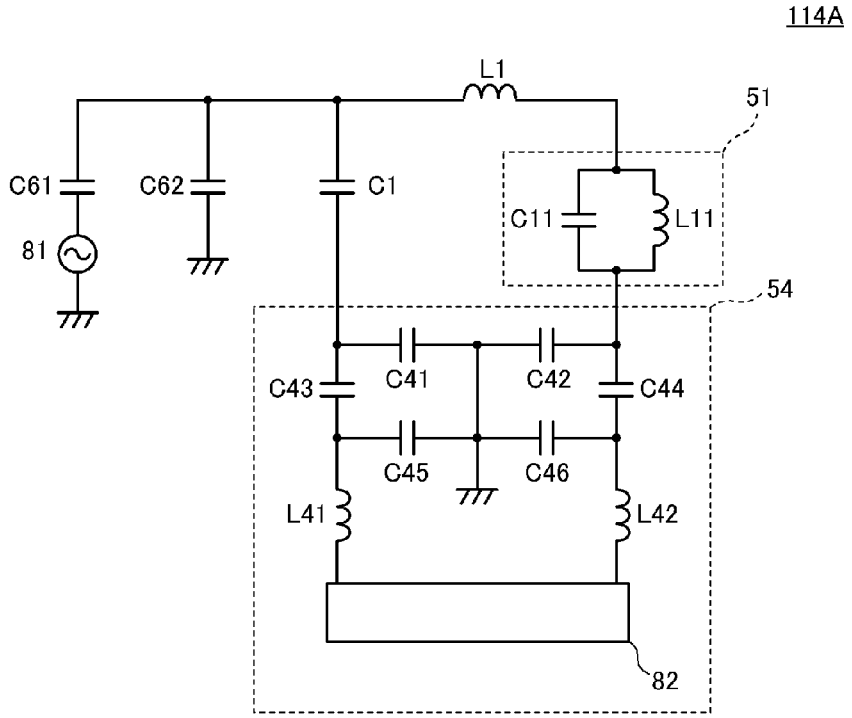
FIG. 29 is an equivalent circuit diagram of lumped elements in an antenna apparatus 114A according to a fourteenth preferred embodiment of the present invention.
Figure 30:
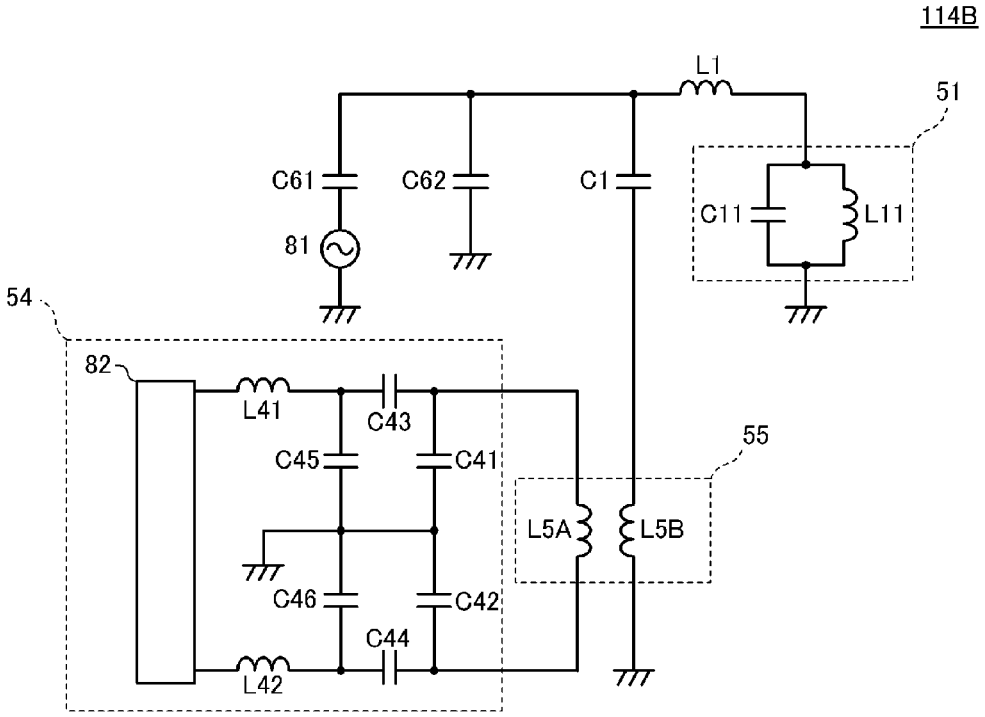
FIG. 30 is an equivalent circuit diagram of lumped elements in an antenna apparatus 114B.

FIG. 29 is an equivalent circuit diagram of lumped elements in an antenna apparatus 114A according to a fourteenth preferred embodiment of the present invention. FIG. 30 is an equivalent circuit diagram of lumped elements in an antenna apparatus 114B.

The antenna apparatus 114A according to the fourteenth preferred embodiment differs from the antenna apparatus 101 according to the first preferred embodiment in that power is directly supplied to the second power supply circuit 82. Accordingly, the antenna apparatus 114A includes no power supply coil. The remaining configuration of the antenna apparatus 114A is substantially the same as that of the antenna apparatus 101 according to the first preferred embodiment.

Only points different from the antenna apparatus 101 according to the first preferred embodiment will now be described.

The antenna apparatus 114A according to the fourteenth preferred embodiment includes a power supply circuit unit 54 including the second power supply circuit 82. The power supply circuit unit 54 includes the second power supply circuit 82, inductors L41 and L42, the capacitors C41, C42, C43, and C44, and capacitors C45 and C46. The antenna apparatus 114A includes no conductive member and the power supply circuit unit 54 is directly connected to the other end of the first impedance circuit 51 and the other end of the capacitor C1.

A low pass filter including the inductors L41 and L42 and the capacitors C45 and C46 is provided between the second power supply circuit 82 and the capacitors C43 and C44 in the power supply circuit unit 54. The power supply circuit unit 54 directly supplies a communication signal in the HF band (the second frequency band) to both ends of the capacitor C41 and both ends of the capacitor C42 via the low pass filter and the capacitors C43 and C44 not through coupling that is spatially separated. Such a power supply circuit may be applied.

The radiating element 1, the capacitors C1, C41, and C42, and the first impedance circuit 51 define an LC resonant circuit. Accordingly, a loop portion including the radiating element 1, the capacitors C1, C41, and C41, and the first impedance circuit 51 is provided.

The antenna apparatus 114B according to the fourteenth preferred embodiment differs from the antenna apparatus 106 according to the sixth preferred embodiment in that power is directly supplied to the second power supply circuit 82. Accordingly, the antenna apparatus 114B includes no power supply coil. The remaining configuration of the antenna apparatus 114B is substantially the same as that of the antenna apparatus 106 according to the sixth preferred embodiment.

Only points different from the antenna apparatus 106 according to the sixth preferred embodiment will now be described.

The antenna apparatus 114B includes the power supply circuit unit 54 including the second power supply circuit 82 and a balun portion 55. The configuration of the power supply circuit unit 54 is substantially the same as that described in the antenna apparatus 114A. The balun portion 55 includes inductors L5A and L5B. The inductors L5A and L5B are magnetically coupled to each other in the balun portion 55 to perform balanced-unbalanced conversion.

The inductor L5A is connected to both ends of the power supply circuit unit 54. In other words, the inductor L5A is connected to both ends of the second power supply circuit 82 via the inductors L41 and L42 and the capacitors C43 and C44. The inductor L5B is connected between the other end of the capacitor C1 and the ground conductor 9. A balanced signal in the power supply circuit unit 54 is converted into an unbalanced signal with the balun portion 55 and power is directly supplied to a loop portion including the radiating element 1, the capacitor C1, the ground conductor 9, and the first impedance circuit 51.

The antenna apparatus is not limited to the configuration in which the second power supply circuit includes the power supply coil and is magnetically or electromagnetically coupled (the electric field coupling and the magnetic field coupling) to the loop portion, as described in the present preferred embodiment. The antenna apparatus may have the configuration in which the second power supply circuit directly supplies power to the loop portion.

Also in the above configuration, the basic configuration of the antenna apparatus 114A is the same as that of the antenna apparatus 101 according to the first preferred embodiment and the basic configuration of the antenna apparatus 114B is the same as that of the antenna apparatus 106 according to the sixth preferred embodiment. Accordingly, the same effects and advantages as those of the antenna apparatuses 101 and 106 are achieved.

Fifteenth Preferred Embodiment

Figure 31:
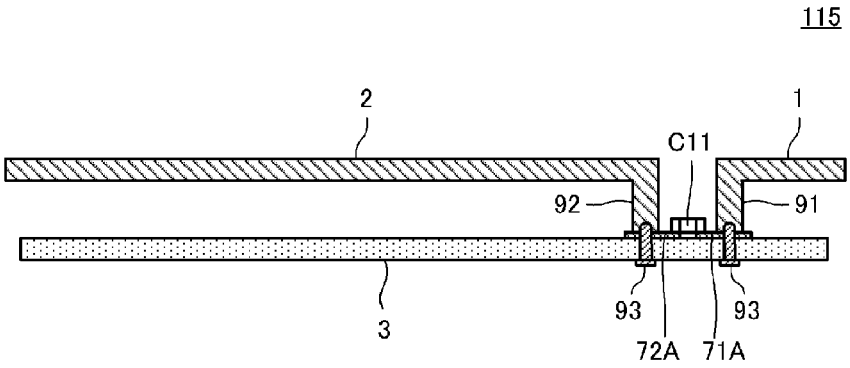
FIG. 31 is a cross-sectional view of an antenna apparatus 115 according to a fifteenth preferred embodiment of the present invention.

FIG. 31 is a cross-sectional view of an antenna apparatus 115 according to a fifteenth preferred embodiment of the present invention.

The antenna apparatus 115 according to the fifteenth preferred embodiment differs from the antenna apparatus 101 according to the first preferred embodiment in that the antenna apparatus 115 includes no connection pin. The remaining configuration of the antenna apparatus 115 is substantially the same as that of the antenna apparatus 101 according to the first preferred embodiment.

Only points different from the antenna apparatus 101 according to the first preferred embodiment will now be described.

The antenna apparatus 115 includes conductive connection portions 91 and 92 and screw members 93, instead of the connection pins. The conductive connection portions 91 and 92 are bending portions of the radiating element 1 and the conductor plate 2, respectively. The conductive connection portion 91 is fixed to the substrate 3 using the screw member 93. As illustrated in FIG. 31, the radiating element 1 is connected to one end of the capacitor C11 via the conductive connection portion 91 and 71A. The conductive connection portion 92 is fixed to the substrate 3 using the screw member 93. As illustrated in FIG. 31, the conductor plate 2 is connected to the other end of the capacitor C1 via the conductive connection portion 92 and 72A.

As described in the present preferred embodiment, the portion to be connected using the connection pin may be connected via the conductive connection portion 91 and the screw member 93. Although the example is described in the present preferred embodiment in which the shapes of the conductive connection portions 91 and 92 are the bending portions of the radiating element 1 and the conductor plate 2, respectively, the antenna apparatus 115 is not limited to this configuration. The conductive connection portions 91 and 92 may be appropriately varied within a range achieving the above advantages. For example, conductive members different from the radiating element 1 and the conductor plate 2 may be fixed to the radiating element 1 and the conductor plate 2 using conductive adhesive.

Although the example is described in the present preferred embodiment in which the conductive connection portions 91 and 92 are fixed to the substrate 3 using the screw members 93, the antenna apparatus 115 is not limited to this configuration. The antenna apparatus 115 may have a configuration in which the conductive connection portions 91 and 92 are fixed to the substrate 3 using conductive adhesive without using the screw members 93.

Alternatively, the antenna apparatus 115 may have a configuration in which a flexible print circuited board is fixed to the substrate 3 without using the connection conductors 71A and 72A to connect a conductive pattern provided on the flexible print circuited board to the connection conductors provided on the substrate 3.

Sixteenth Preferred Embodiment

Figure 32A:
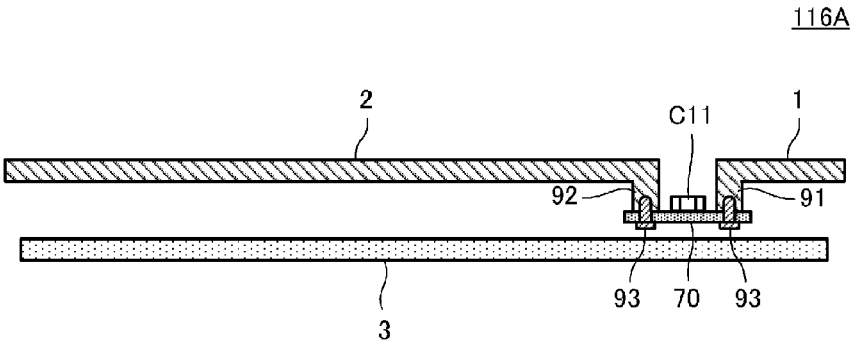
FIG. 32A is a cross-sectional view of an antenna apparatus 116A according to a sixteenth preferred embodiment of the present invention and FIG. 32B is a cross-sectional view of an antenna apparatus 116B.
Figure 32B:
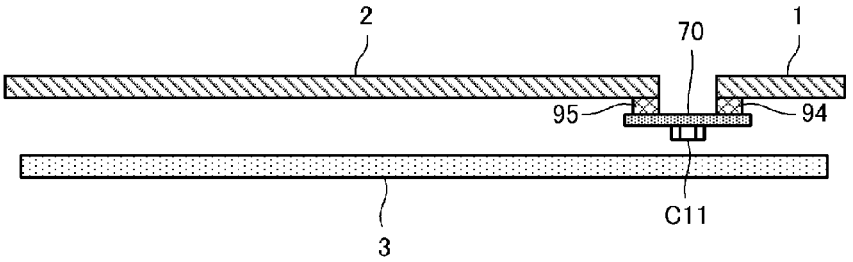

FIG. 32A is a cross-sectional view of an antenna apparatus 116A according to a sixteenth preferred embodiment of the present invention. FIG. 32B is a cross-sectional view of an antenna apparatus 116B.

The antenna apparatuses 116A and 116B according to the sixteenth preferred embodiment differ from the antenna apparatus 101 according to the first preferred embodiment in that the capacitor C11 is not mounted on the substrate 3. The remaining configurations of the antenna apparatuses 116A and 116B are substantially the same as that of the antenna apparatus 101 according to the first preferred embodiment.

Only points different from the antenna apparatus 101 according to the first preferred embodiment will now be described.

The antenna apparatus 116A further includes the conductive connection portions 91 and 92, the screw members 93, and a wiring substrate 70. A conductive pattern (not illustrated) is provided on a first main surface (an upper surface in FIG. 32A) of the wiring substrate 70. The wiring substrate 70 is, for example, a flexible printed circuit board.

The capacitor C11 is mounted on the first main surface of the wiring substrate 70. The conductive connection portion 91 is a bending portion of the radiating element 1 and is fixed to the wiring substrate 70 using the screw member 93. The conductive connection portion 92 is a bending portion of the conductor plate 2 and is fixed to the wiring substrate 70 using the screw member 93. The radiating element 1 and the conductor plate 2 are connected to the capacitor C11 via the conductive pattern provided on the first main surface of the wiring substrate 70 and the conductive connection portions 91 and 92.

The antenna apparatus 116B further includes conductive adhesives 94 and 95 and the wiring substrate 70. A conductive pattern (not illustrated) is provided on the wiring substrate 70.

The capacitor C11 is mounted on a second main surface (a lower surface in FIG. 32B) of the wiring substrate 70. The radiating element 1 is connected to one end of the capacitor C11 via the conductive pattern provided on the wiring substrate 70, the conductive adhesive 94, and so on. The conductor plate 2 is connected to the other end of the capacitor C11 via the conductive pattern provided on the wiring substrate 70, the conductive adhesive 95, and so on.

With the above configuration, it is not necessary to connect the radiating element 1 to the substrate 3 and to connect the conductor plate 2 to the substrate 3.

In addition, since the components including the capacitor C11 are capable of being mounted on the wiring substrate 70 in the present preferred embodiment, the mounting space on the substrate 3 is increased in size and the degree of freedom of, for example, the arrangement of the mounted components is improved.

Although the example is described in which the wiring substrate 70 is fixed to the conductive connection portions 91 and using the screw members 93 in the antenna apparatus 116A according to the present preferred embodiment, the antenna apparatus 116A is not limited to this configuration. As illustrated in the antenna apparatus 116B, the configuration may be adopted in which the wiring substrate 70 is fixed using the conductive adhesives without using the screw members 93.

Seventeenth Preferred Embodiment

Figure 33:
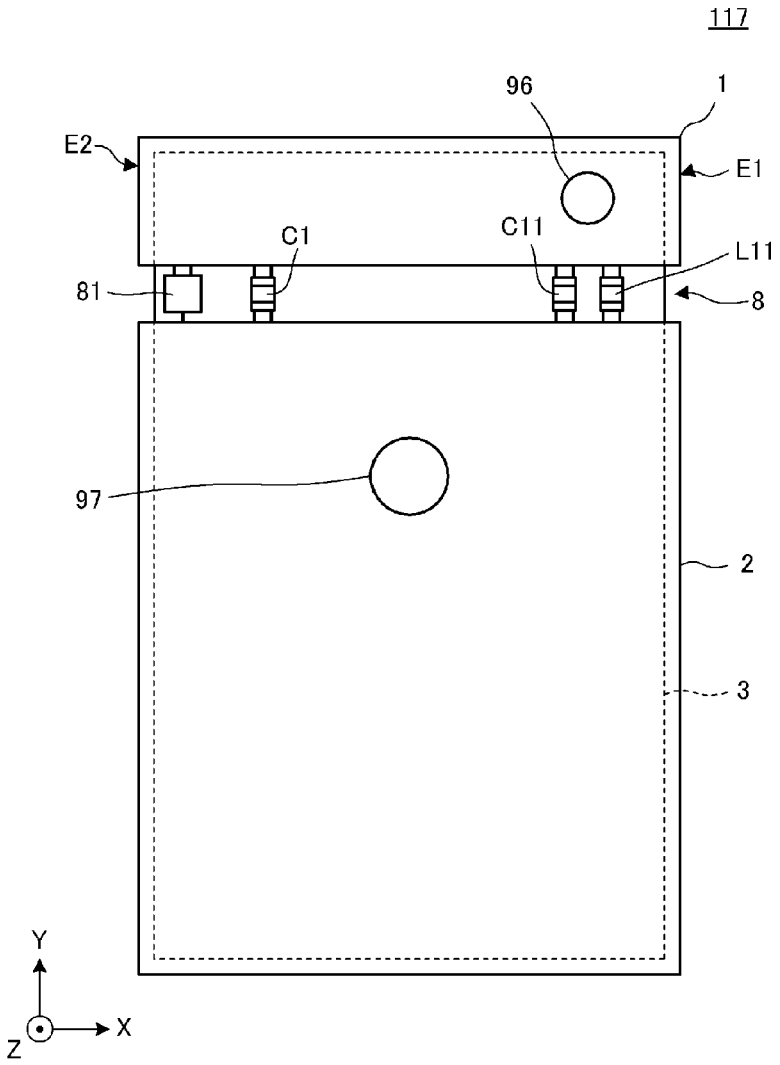
FIG. 33 is a plan view of an antenna apparatus 117 according to a seventeenth preferred embodiment of the present invention.

FIG. 33 is a plan view of an antenna apparatus 117 according to a seventeenth preferred embodiment of the present invention. The first impedance circuit, the capacitors, the second power supply circuit, the reactance elements, and so on are not illustrated in FIG. 33.

The antenna apparatus 117 according to the seventeenth preferred embodiment differs from the antenna apparatus 101 according to the first preferred embodiment in that the antenna apparatus 117 further includes openings 96 and 97. The remaining configuration of the antenna apparatus 117 is substantially the same as that of the antenna apparatus 101 according to the first preferred embodiment.

Only points different from the antenna apparatus 101 according to the first preferred embodiment will now be described.

The radiating element 1 in the antenna apparatus 117 includes the opening 96 and the conductor plate 2 in the antenna apparatus 117 includes the opening 97. Each of the openings 96 and 97 is, for example, an opening for a camera module or an opening for a button.

Also in the above configuration, the basic configuration of the antenna apparatus 117 is the same as that of the antenna apparatus 101 according to the first preferred embodiment and the same effects and advantages as those of the antenna apparatus 101 are achieved.

The positions, the sizes, the numbers, and so on of the openings 96 and 97 described in the present preferred embodiment are only examples and the antenna apparatus 117 is not limited to this configuration. The positions, the sizes, the numbers, and so on of the openings 96 and 97 may be appropriately varied within a range in which the radiating element 1 and the conductor plate 2 define a loop portion to function as a booster antenna.

Although the example is described in the present preferred embodiment in which the radiating element 1 and the conductor plate 2 compose a loop portion, the antenna apparatus 117 is not limited to this configuration. The ground conductor may include an opening and the radiating element 1 and the ground conductor may define a loop portion. The positions, the sizes, the numbers, and so on of the opening of the ground conductor may be appropriately varied within a range in which the radiating element 1 and the ground conductor define a loop portion to function as a booster antenna. Resin or the like expressing a device or an emblem, such as a speaker or a sensor, may be located at the openings 96 and 97.

Eighteenth Preferred Embodiment

Figure 34:
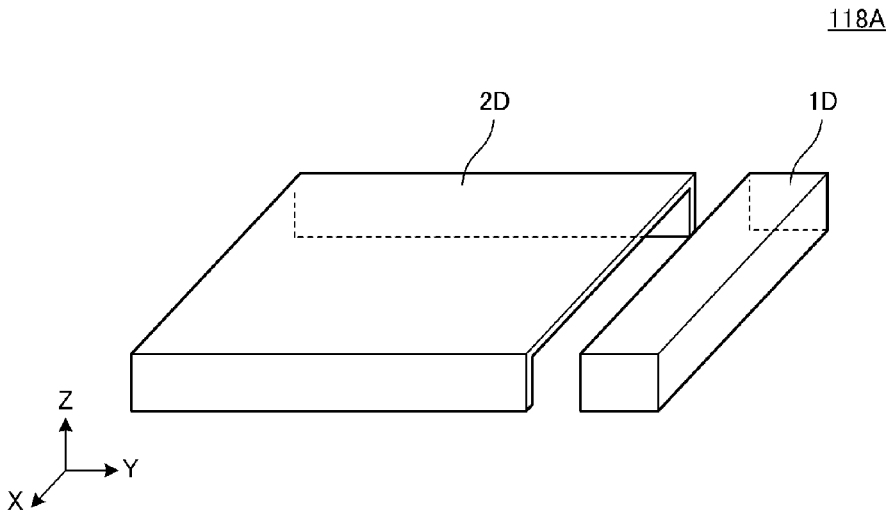
FIG. 34 is an external perspective view illustrating a radiating element 1D and a conductor plate 2D in an antenna apparatus 118A according to an eighteenth preferred embodiment of the present invention.
Figure 35:
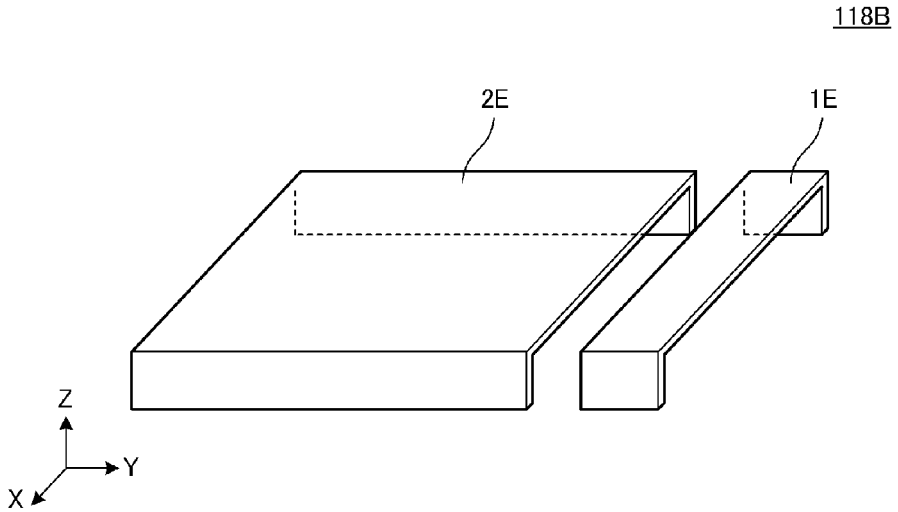
FIG. 35 is an external perspective view illustrating a radiating element 1E and a conductor plate 2E in an antenna apparatus 118B.
Figure 36:
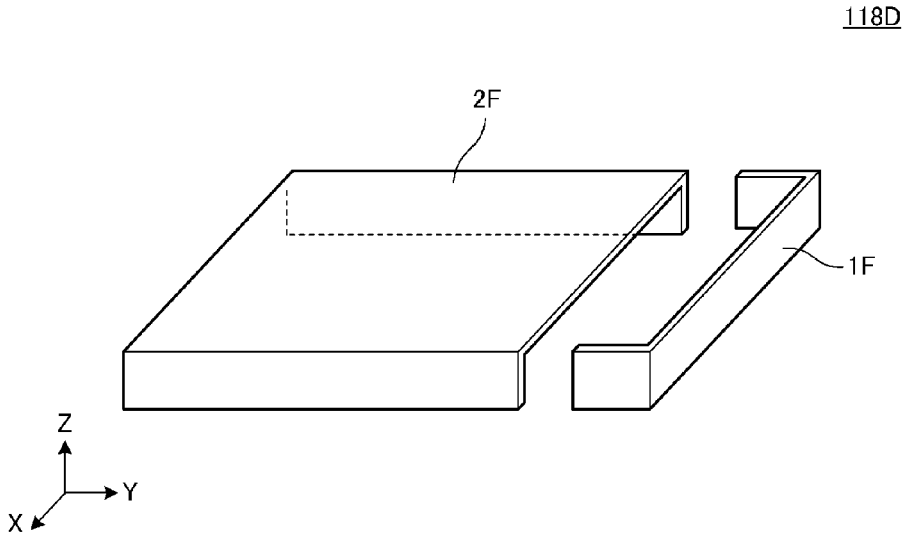
FIG. 36 is an external perspective view illustrating a radiating element 1F and a conductor plate 2F in an antenna apparatus 118C.

FIG. 34 is an external perspective view illustrating a radiating element 1D and a conductor plate 2D in an antenna apparatus 118A according to an eighteenth preferred embodiment of the present invention. FIG. 35 is an external perspective view illustrating a radiating element 1E and a conductor plate 2E in an antenna apparatus 118B. FIG. 36 is an external perspective view illustrating a radiating element 1F and a conductor plate 2F in an antenna apparatus 118C. Referring to FIG. 34, FIG. 35, and FIG. 36, the first impedance circuit, the capacitors, the first power supply circuit, the second power supply circuit, the reactance elements, and so on are not illustrated.

The antenna apparatuses 118A, 118B, and 118C differs from the antenna apparatus 101 according to the first preferred embodiment in the shapes of the radiating elements and the conductor plates. The remaining configurations of the antenna apparatuses 118A, 118B, and 118C are substantially the same as that of the antenna apparatus 101 according to the first preferred embodiment.

Only points different from the antenna apparatus 101 according to the first preferred embodiment will now be described.

The radiating element 1D in the antenna apparatus 118A is not a flat plate. Side surfaces of the radiating element 1D are connected on both sides in the lateral direction (the X direction in FIG. 34) and on one side (the right side in FIG. 34) in the longitudinal direction (the Y direction). The conductor plate 2D in the antenna apparatus 118A is not a flat plate and side surfaces of the conductor plate 2D are connected on both sides in the lateral direction (the X direction). As illustrated in FIG. 34, the conductor plate 2D is a U-shaped conductor, viewed from the Y direction.

The radiating element 1E in the antenna apparatus 118B is not a flat plate and side surfaces of the radiating element 1E are connected on both sides in the lateral direction (the X direction in FIG. 35). As illustrated in FIG. 35, the radiating element 1E is a U-shaped conductor, viewed from the Y direction. The conductor plate 2E in the antenna apparatus 118B has substantially the same shape as that of the conductor plate 2D in the antenna apparatus 118A.

The radiating element 1F in the antenna apparatus 118C is not a flat plate. Side surfaces of the radiating element 1F are connected on both sides in the lateral direction (the X direction in FIG. 36) and on one side (the right side in FIG. 36) in the longitudinal direction (the Y direction). As illustrated in FIG. 36, the radiating element 1F is a U-shaped conductor, viewed from the Z direction. The conductor plate 2F in the antenna apparatus 118C is not a flat shape. Side surfaces of the conductor plate 2F are connected on both sides in the lateral direction (the X direction) and on the other side (the left side in FIG. 36) in the longitudinal direction (the Y direction).

As described in the present preferred embodiment, the shapes of the radiating element 1 and the conductive member (the conductor plate or the ground conductor) may be appropriately varied within a range in which the radiating element 1 and the conductive member define a portion of the loop portion to function as a booster antenna. For example, the radiating element 1 and the conductive member may each have a three-dimensional structure.

As described in the present preferred embodiment, the radiating element 1 and the conductive member (the conductor plate or the ground conductor) is not limited to flat plates. The thicknesses (the length in the Z direction) of the radiating element 1 and the conductive member may be appropriately varied within a range in which the radiating element 1 and the conductive member define a portion of the loop portion to function as a booster antenna.

Other Preferred Embodiments

Although the examples are described in the above preferred embodiments in which the radiating element 1 and the conductive member (the conductor plate or the ground conductor) have rectangular or substantially rectangular planar shapes, the radiating element 1 and the conductive member are not limited to this configuration. The radiating element 1 and the conductive member may have, for example, curved or linear shapes. The shapes of the radiating element 1 and the conductive member may be appropriately varied within a range in which the radiating element 1 and the conductive member define a portion of the loop portion to function as a booster antenna.

Although the examples are described in the above preferred embodiments in which the loop portion defines and functions as the magnetic-field radiation antenna that contributes to the magnetic-field radiation for neighborhood communication in the HF band (the second frequency band), the loop portion is not limited to this configuration. The loop portion may be used as a power reception antenna or a power transmission antenna for, for example, a non-contact power transmission system of an electromagnetic type or a non-contact power transmission system of a magnetic field resonance type, which uses at least the magnetic field coupling. When the antenna apparatus according to any of the above preferred embodiments is used in a power transmission apparatus, the loop portion defines and functions as the power transmission antenna and the second power supply circuit defines and functions as a power transmission circuit that supplies power to the power transmission antenna. When the antenna apparatus according to any of the above preferred embodiments is used in a power reception apparatus, the loop portion defines and functions as the power reception antenna and the second power supply circuit defines and functions as a power reception circuit that supplies power from the power reception antenna to a load in the power reception apparatus.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A communication terminal apparatus comprising:

a housing including a first conductor and a second conductor;

a substrate opposing the first conductor or the second conductor;

a capacitor connected between the first conductor and the second conductor;

a power supply coil; and a loop including the first conductor, the second conductor, and the capacitor; wherein the first conductor and the second conductor are spaced from the substrate;

the loop defines an LC resonant circuit and is magnetically coupled to the power supply coil;

standing waves are generated in a first frequency band in the first conductor; and the loop resonates in a second frequency band lower than the first frequency band.

2. The communication terminal apparatus according to claim 1, further comprising:

a first impedance circuit that includes a first parallel resonant circuit and that is connected between the first conductor and the second conductor; wherein the first impedance circuit is included in the loop; and the first parallel resonant circuit has a higher impedance in the first frequency band than in the second frequency band.

3. The communication terminal apparatus according to claim 1, wherein the capacitor is connected near a first end portion in a long-side direction of the first conductor.

4. The communication terminal apparatus according to claim 1, wherein the capacitor is connected between the first conductor and the second conductor via a flexible wiring substrate.

5. The communication terminal apparatus according to claim 1, wherein the first conductor is defined by a portion of the housing or is held in the housing.

6. The communication terminal apparatus according to claim 1, wherein the second conductor is defined by a portion of the housing or is held in the housing.

7. The communication terminal apparatus according to claim 1, wherein the communication terminal apparatus is one of a smartphone and a tablet terminal.

8. The communication terminal apparatus according to claim 1, wherein the first frequency band is in the UHF band or in the SHF band, and the second frequency band is in the HF band.

* * * * *